US006413707B1

(12) United States Patent
Schroeder et al.

(10) Patent No.: US 6,413,707 B1
(45) Date of Patent: Jul. 2, 2002

(54) PHOTOGRAPHIC ELEMENT WITH YELLOW DYE-FORMING COUPLER AND STABILIZING COMPOUND HAVING IMPROVED LIGHT STABILITY

(75) Inventors: Kurt M. Schroeder; James S. Honan, both of Spencerport; Brian Thomas, Pittsford; Thomas A. Rosiek; Paul D. Yacobucci, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/943,119

(22) Filed: Aug. 30, 2001

Related U.S. Application Data

(63) Continuation-in-part of application No. 09/750,738, filed on Dec. 29, 2000.

(51) Int. Cl.[7] ..... G03C 1/08; G03C 7/26; G03C 7/32

(52) U.S. Cl. ..... 430/551; 430/556; 430/557; 430/546; 430/631

(58) Field of Search ..... 430/551, 556, 430/557, 546, 631

(56) References Cited

U.S. PATENT DOCUMENTS

| | | | | |
|---|---|---|---|---|
| 4,248,958 | A | | 2/1981 | Faust |
| 4,499,179 | A | | 2/1985 | Ota et al. |
| 4,840,881 | A | * | 6/1989 | Watanabe et al. ..... 430/546 |
| 4,873,365 | A | | 10/1989 | Luh et al. |
| 4,960,638 | A | | 10/1990 | Mukoyoshi et al. |
| 5,173,396 | A | | 12/1992 | Nagasaki et al. |
| 5,200,303 | A | | 4/1993 | Takahashi et al. |
| 5,260,177 | A | | 11/1993 | Aoki et al. |
| 5,405,736 | A | | 4/1995 | Young |
| 5,972,324 | A | | 10/1999 | Zofchak et al. |
| 5,981,159 | A | | 11/1999 | Nielsen et al. |
| 6,221,572 | B1 | | 4/2001 | Hagemann et al. |

FOREIGN PATENT DOCUMENTS

| | | |
|---|---|---|
| EP | 523640 B1 | 9/1995 |
| JP | 3256787 | 11/1991 |
| JP | 11-271940 | 11/1999 |

* cited by examiner

*Primary Examiner*—Geraldine Letscher
(74) *Attorney, Agent, or Firm*—Andrew J. Jackson

(57) ABSTRACT

A photographic element is disclosed comprising a silver halide emulsion layer having associated therewith an acetanilide based yellow dye forming coupler and a compound of the following Formula I:

wherein $R^1$, $R^2$ and $R^3$ are each independently aromatic, cyclic, linear, or branched chained hydrocarbon groups. The invention provides photographic elements which exhibit exceptional yellow dye light stability, and which retain desirable properties derived from the use of acetanilide based yellow dye-forming couplers, particularly when used in combination with substituted phenolic and/or thiomorpholine dioxide stabilizers. In addition to stabilizing properties, compounds of Formula I have organic solvent properties, and accordingly may be advantageously used partly or totally in place of conventional high boiling permanent and/or auxiliary organic coupler solvents to disperse the acetanilide-based couplers.

22 Claims, No Drawings

PHOTOGRAPHIC ELEMENT WITH YELLOW DYE-FORMING COUPLER AND STABILIZING COMPOUND HAVING IMPROVED LIGHT STABILITY

CROSS-REFERENCE TO RELATED APPLICATIONS

This application is a continuation-in-part of U.S. Ser. No. 09/750,738, filed Dec. 29, 2000, the disclosure of which is incorporated by reference herein.

FIELD OF INVENTION

This invention relates to silver halide color photographic materials. More particularly, it relates to color photographic materials which contain yellow dye-forming couplers in combination with certain non-imaging compounds which give rise to images which have high stability towards fading by light.

BACKGROUND OF THE INVENTION

In a silver halide photographic element, a color image is formed when the element is exposed to light and then subjected to color development with a primary aromatic amine developer. Color development results in imagewise reduction of silver halide and production of oxidized developer. Oxidized developer reacts with one or more incorporated dye-forming couplers to form an imagewise distribution of dye.

In any polychromatic chromogenic photographic material it is desirable that the dyes so formed should have certain properties. For instance, the dyes should be bright in color with very little secondary absorption so that good color reproducibility is obtained. For yellow dyes in particular, color purity is enhanced by ensuring that the absorption maximum of the dye is well separated from that of the magenta dye and hence, yellow dyes that absorb at shorter wavelengths are advantageous. Acetanilide-based yellow dye-forming couplers have been found to provide desirable hues. The dyes that are formed by any color coupler during processing have a tendency to fade over times as a result of exposure to light, heat, humidity and oxygen resulting in a deterioration of the original recorded image. It is therefore highly desirable that the yellow dyes should be resistant towards fading by heat, humidity and light.

Acetanilide-based yellow dye-forming couplers of the general structures described in this invention are well known in the photographic art. Techniques are known in the art for providing resistance to light fade of such photographic yellow dyes. Compounds which have been disclosed as light stabilizers for yellow image dyes include substituted phenolic and blocked phenolic compounds including; heterocyclic phosphorous materials (U.S. Pat. No. 4,749,645), phenolic thiane derivatives (EP 0 310 551), substituted and blocked bisphenols (UK 1,267,287, U.S. Pat. No. 4,782,011, DE 4,307,439, DE 4,307,439, DE 4,320,828, EP 0 508 398, EP 0 538 862, U.S. Pat. Nos. 5,294,530, 5,426,021, 5,441,855, 5,441,861, 5,466,569, 5,891,613, WO 91/008,515, U.S. Pat. Nos. 5,567,578, 5,284,742, 5,091,294, EP 0 310 552, U.S. Pat. No. 5,935,773). In addition, yellow dyes may also be stabilized against fading by light with the use of thiomorpholine dioxide compounds as described in copending, commonly assigned U.S. Ser. No. 09/483,396 filed Jan. 14, 2000, the disclosure of which is incorporated by reference herein. However, it is desirable to improve on the light stabilization of yellow dyes beyond that afforded with use of the above stabilizers.

Acetanilide-based yellow dyes can also be stabilized against light fade with the use of some polymeric stabilizers. Polymeric compounds which have been disclosed as light stabilizers for yellow image dyes include, for example, those described in U.S. Pat. Nos. 4,857,449; 5,001,045; 5,047,314; 5,055,386; 5,200,304; 5,242,788; 5,294,527, 5,558,980, 5,594,047, and 5,981,159. Various techniques have been disclosed for preparing photographic dispersions of yellow dye-forming couplers and latex polymers, e.g., as described in U.S. Pat. Nos. 5,594,047 and 5,558,980. However, dispersions of yellow dye-forming couplers and polymeric addenda coated in a photographic element, whether it be the use of polymer latex particles or low molecular weight organic solvent soluble polymers, have disadvantages. With respect to polymer latex particles, they can be difficult to clean in large-scale manufacturing. In photographic elements, density increases after thermal treatments are also caused by the use of high levels of latex polymers. With respect to the solvent soluble polymers, they can be difficult to dissolve in coupler dispersions without the use of a low-boiling water-immiscible solvent, such as ethyl acetate. This is environmentally unfavorable, and often requires the additional step of removing the solvent before it can be coated in large-scale manufacture of photographic materials.

Typically, the yellow dye-forming color coupler and polymeric light stabilizer are dispersed in gelatin or other colloidal binder. In the dry state the gelatin is hard and can easily transmit applied stress to the silver halide grains. This can result in an unwanted "fogging" of the emulsion, meaning that a latent image site is formed due to the transmitted stress and not due to exposure with light. This is typically referred to as "pressure fog". Techniques are known in the art to reduced pressure sensitivity by addition of dispersions of organic solvents to photographic elements (U.S. Pat. Nos. 4,840,881 and 4,499,179). However, these organic solvents are not themselves capable of providing light stability, most often degrading light stability, and can be used at such high levels that other problems are encountered such as delamination between adjacent layers in the photographic element. Similarly, prior art discloses the use of low glass transition temperature polymer latex into coated photographic elements to reduce pressure sensitivity (U.S. Pat. Nos. 3,576,628 and 4,822,727). Additional art discloses the use of gelatin-grafted and case-hardened gelatin-grafted soft latex polymer particles in combination with certain sugar surfactants (U.S. Pat. Nos. 5,066,572, 5,426,020 and 5,393,650). However, these particles do not offer any protection from fading of yellow image dyes due to light. Some latex polymers can be formulated to provide both light stability and pressure fog protection, such as described in U.S. Pat. No. 5,981,159. These latex polymers have the disadvantages mentioned previously.

Yet another method of stabilizing yellow dyes to fading by light is to disperse the yellow dye forming couplers in solid coupler solvents, such as alkyl alcohols or dialkyl or diaryl phosphates, according to U.S. Pat. No. 5,405,736. Such approaches can be disadvantaged in that the solid coupler solvent may precipitate or may cause precipitation of the yellow dye forming coupler or other solid materials during storage of the dispersion, which could lead to defects in the manufacture of a photographic element. Therefore, it is desirable to provide alternative methods of providing stabilization of yellow dyes to the fading of light without the inherent difficulties associated with known techniques of light stabilization.

SUMMARY OF THE INVENTION

An objective of this invention is to provide photographic elements which exhibit exceptional yellow dye light stability, and which retain desirable properties derived from the use of acetanilide based yellow dye-forming couplers. A further objective of the invention is to provide reduced pressure sensitivity for photographic elements comprising acetanilide based yellow dye-forming couplers.

In accordance with one embodiment of the invention, a photographic element is disclosed comprising a silver halide emulsion layer having associated therewith an acetanilide based yellow dye forming coupler and a compound of the following Formula I:

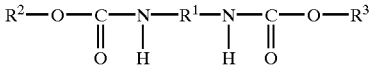

wherein $R^1$, $R^2$ and $R^3$ are each independently aromatic, cyclic, linear, or branched chained hydrocarbon groups. We have found that the objectives of the invention can be achieved with acetanilide-based couplers through the use of urethane compounds of Formula I as stabilizing addenda, particularly when used in combination with known substituted phenolic and/or thiomorpholine dioxide stabilizers. In addition to stabilizing properties, compounds of Formula I have organic solvent properties, and accordingly may be advantageously used partly or totally in place of conventional high boiling permanent and/or auxiliary organic coupler solvents to disperse the acetanilide-based couplers. Unexpected and substantial improvements in the light stability of the image dyes can be obtained, and, in accordance with preferred embodiments of the invention, the presence of the urethane compound does not degrade the pressure sensitivity of the resulting photographic element where the melting point of the compound is less than 110° C. Accordingly, photographic elements of the present invention upon exposure and photographic processing exhibit good activity and yield yellow dye images that have low fading when exposed to light and are less susceptible to pressure induced sensitometric defects.

DETAILED DESCRIPTION OF THE INVENTION

The photographic elements of this invention can be chromogenic black and white elements (for example, using magenta and cyan dye forming couplers in combination with yellow dye forming couplers), single color elements or multicolor elements. In addition to a yellow dye image forming layer, the photographic elements in accordance with preferred embodiments of the invention further comprise at least one cyan image forming layer and at least one magenta image forming layer. More particularly, multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, non-diffusing color-forming couplers are incorporated in the light-sensitive photographic emulsion layers so that during development, they are available in the emulsion layer to react with the color developing agent that is oxidized by silver halide image development. When the dye image formed is to be used in situ, couplers are selected which form non-diffusing dyes. Color photographic systems can also be used to produce black-and-white images from non-diffusing couplers as described, e.g., by Edwards et al. in International Publication No. WO 93/012465.

Throughout this application a reference to any type of chemical "group" includes both the unsubstituted and substituted forms of the group described. Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

Acetanilide-based yellow dye forming coupler compounds employed in the elements of the present invention are known compounds and can be prepared by techniques known to those skilled in the art. Individual yellow couplers may be used singly or in combinations. Couplers that form yellow dyes upon reaction with oxidized color developing agent and which are useful in elements of the invention are described, e.g., in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred acetanilide-based yellow couplers are represented by the following formulas:

YELLOW-1

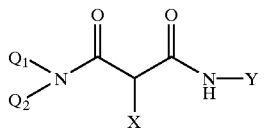

-continued

YELLOW-2

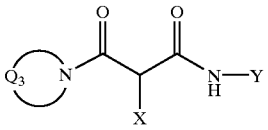

YELLOW-3

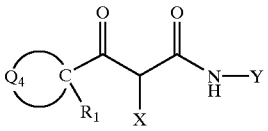

YELLOW-4

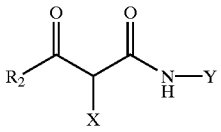

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group. The elements of the invention are particularly useful in combination with yellow couplers of the above formulas wherein X represents a nitrogen-containing heterocyclic coupling-off group.

Representative yellow couplers which may be used in the elements of the invention include the following:

YC1

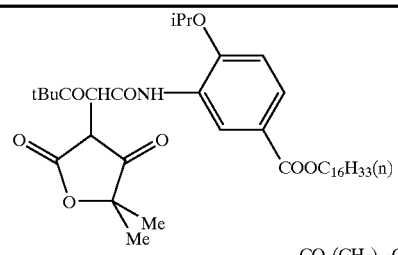

YC2

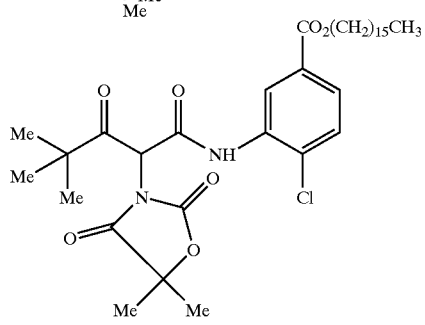

YC3

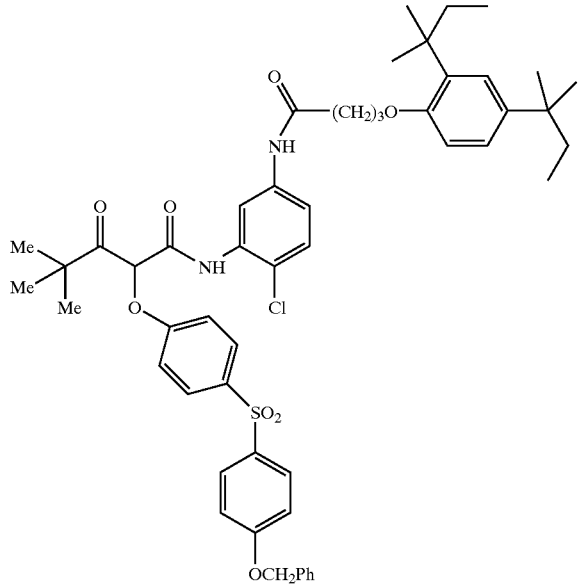

-continued
YC4
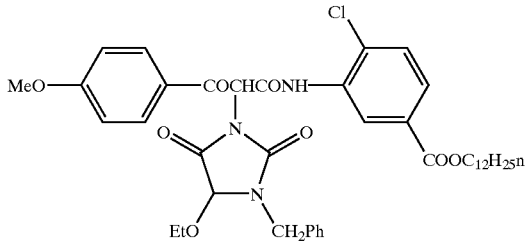
YC5
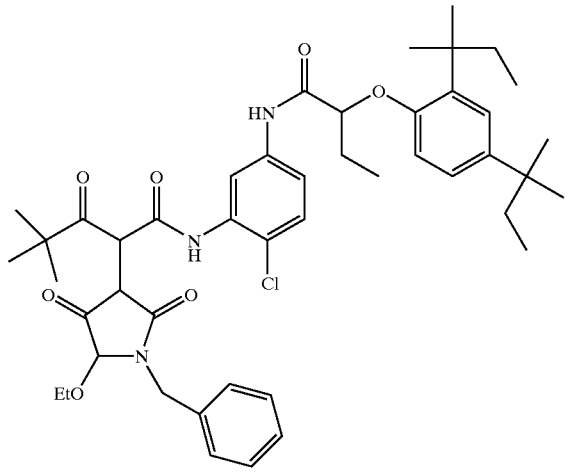
YC6
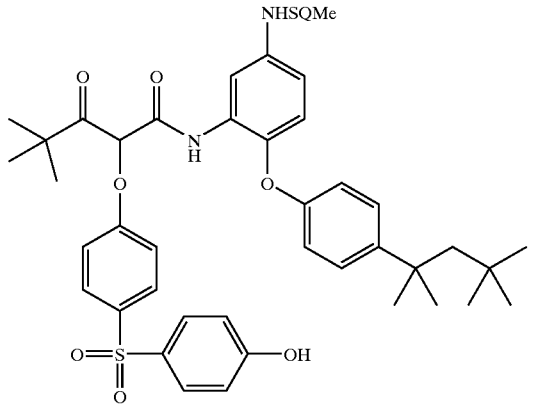
YC7
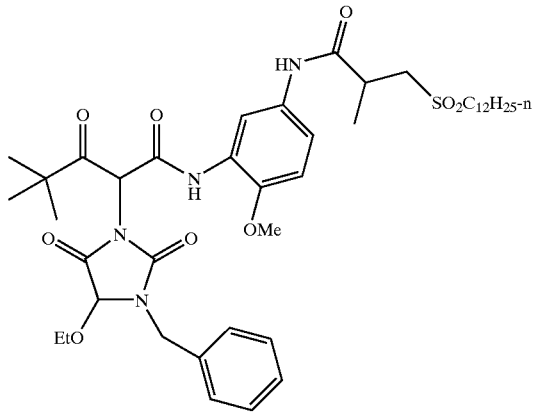

-continued
YC8
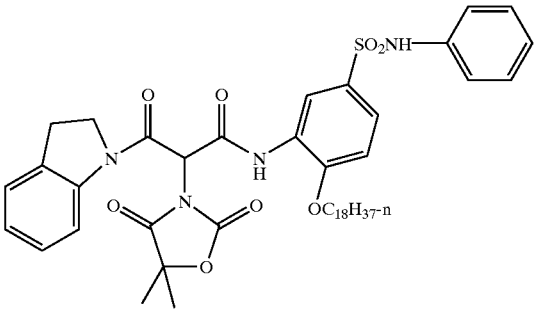
YC9
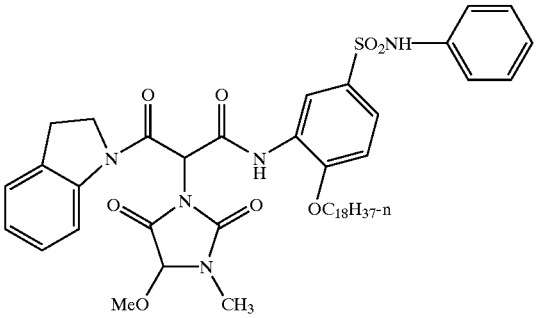
YC10
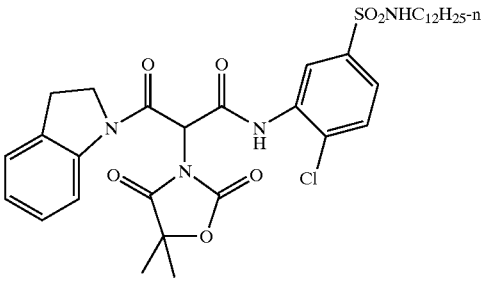
YC11
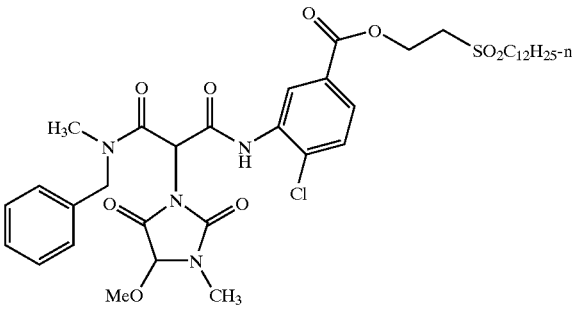
YC12
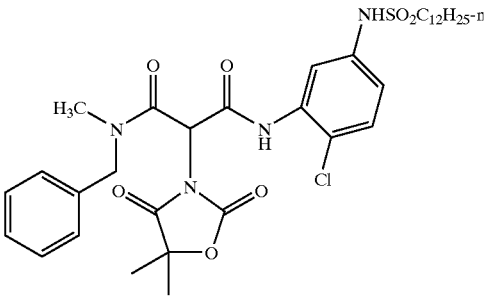

-continued
YC13
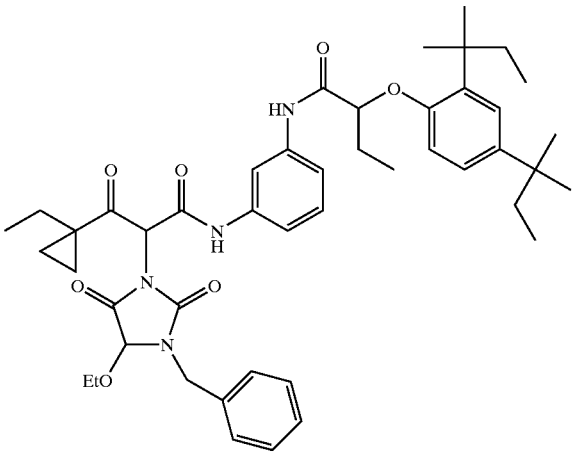
YC14
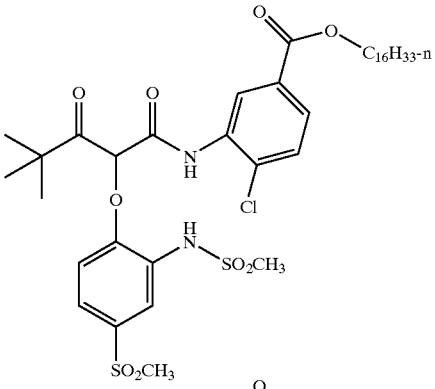
YC15
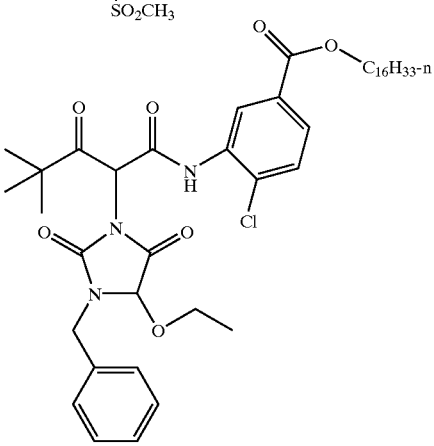
YC16
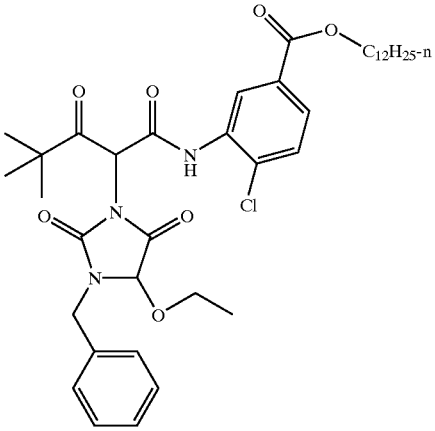

-continued

YC17

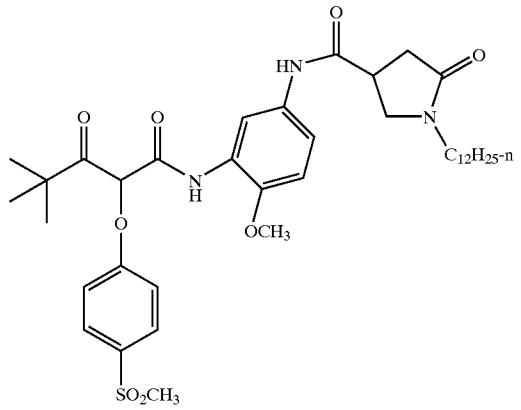

YC18

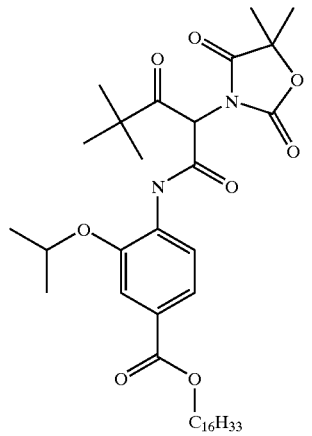

Urethane compounds of Formula I which are employed as light stabilizing compounds in photographic elements in combination with acetanilide based yellow dye formig couplers in accordance with the present invention may be prepared according to synthetic methods known in the art. Many diurethane compounds are commercially available and known in the open literature, for example, as emollients for use in cosmetics applications according to U.S. Pat. No. 5,972,324. Diurethane compounds are also known for use with ink-jet recording papers which show good printability with aqueous inks according to U.S. Pat. No. 4,960,638 and JP 02001360. Thermal recording materials are disclosed which contain a color former, color developer and urethane compound which show improved thermal sensitivity and prevention of undesired discoloration due to pressure according to JP 03256787. Urethane compounds are also disclosed as stabilizers for polymers, "Polymer Degradation and Stability", volume 68, 2000, pp. 127–132. A general synthetic procedure involves reacting two molar equivalents of monohydric alcohols with a diisocyanate according to the following reaction in the presence of heat and a catalyst such as dibutyltin laurate:

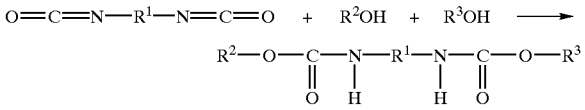

The diisocyanate can be chosen such that $R^1$ is from the group of aromatic, cyclic, linear or branched chain hydrocarbon groups, preferably of from 1 to 30 carbon atoms, more preferably from 6 to 22 carbon atoms. Representative examples include: Isophorone diisocyanate, p-phenylene diisocyanate, toluene diisocyanate, 4,4'-methylenebis-(phenylisocyanate), 1,5-naphthalene diisocyanate, bitolyene diisocyanate, m-xylylene diisocyanate, m-tetramethyl xylylene diusocyanate, 1,6-diisocyanato-2,2,4,4-tetramethylhexane, trans-cylcohexane-1,4-diisocyanate, 1,3-bis(isocyanatomethyl)cyclohexane, dicyclohexylmethane diisocyanate, methylene diisocyanate, ethylene diisocyanate; tri, tetra, penta, hexa, nona and decamethylene diisocyanates and the like.

$R^2$ and $R^3$ are aromatic, cyclic, linear or branched chain hydrocarbon groups, which may be the same or different, each preferably ranging from 1 to 22 carbon atoms, more preferably from 2 to 14 carbon atoms and most preferably from 4 to 10 carbon atoms, with linear, cyclic or branched chained alkyl groups being preferred. Representative examples of $R^2OH$ and $R^3OH$ include: Ethanol, propanol, iso-propanol, butanol, iso-butanol, pentanol, hexanol, ethylhexanol, nonanol, iso-nonanol, decanol, iso-decanol, undecanol, dodecanol, tridecanol, tetradecanol, myristyl alcohol, pentadecyl alcohol, cetyl alcohol, stearyl alcohol, arachidyl alcohol, behenyl alcohol, undecylenyl alcohol, palmitoleyl alcohol, oleyl alcohol, linoleyl alcohol, linolenyl alcohol, arachidonyl alcohol, erucyl alcohol, benzyl alcohol, cyclohexyl alcohol, phenoxyethanols and phenols. This list is non exhaustive and may also include numerous other monohydric alcohols having a terminal hydroxy group at the end of a linear, branched chain, cyclic, or aromatic hydrocarbon.

In accordance with preferred embodiments of the invention, the $R^1$, $R^2$ and $R^3$ groups are preferably selected such that the melting point of the resulting compound is less than 110° C. Addition of a compound of Formula I having a melting point of less than 110° C. to photosensitive layer coatings advantageously provides improved pressure sensitivity performance in combination with improved light stability.

Representative compounds of Formula I which may be used in accordance with the present invention are as follows:

I-1

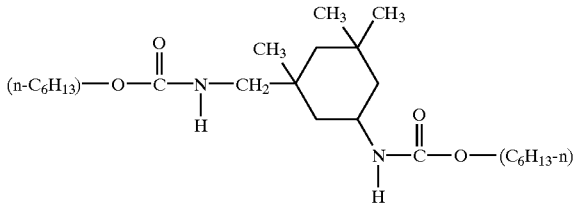

I-2

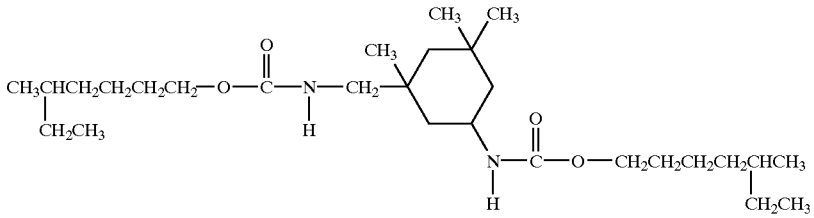

I-3

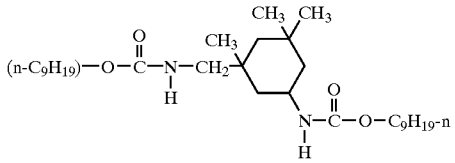

I-4

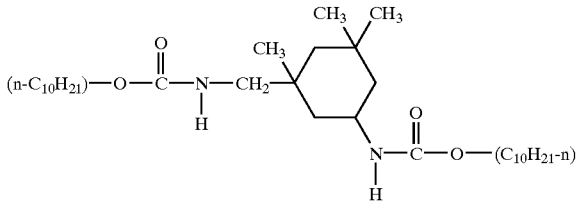

I-5

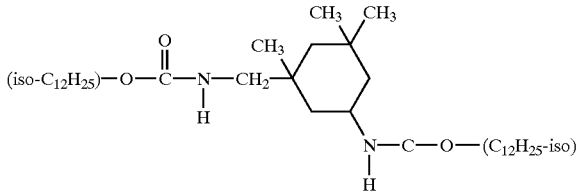

I-6

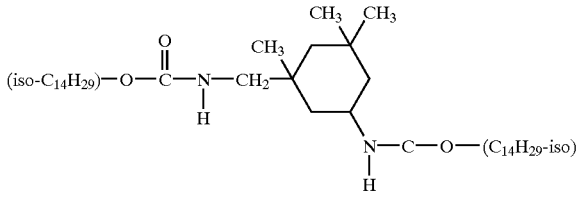

I-7

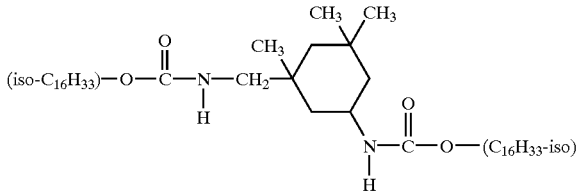

-continued
I-8
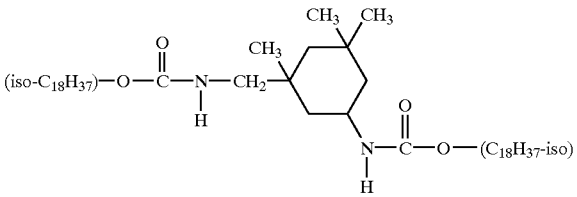
I-9
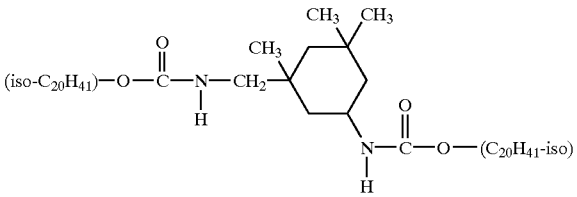
I-10
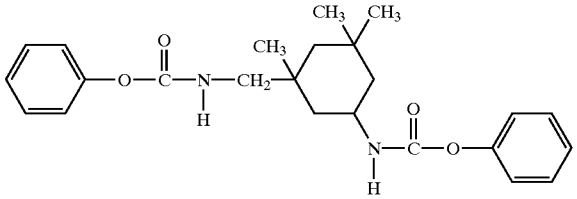
I-11
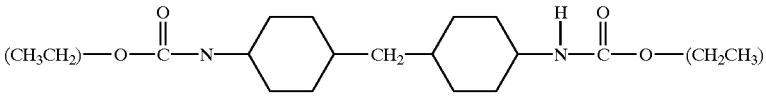
I-12
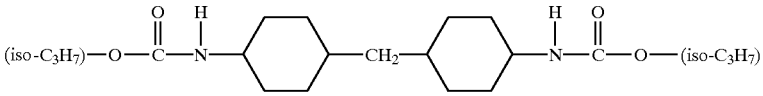
I-13
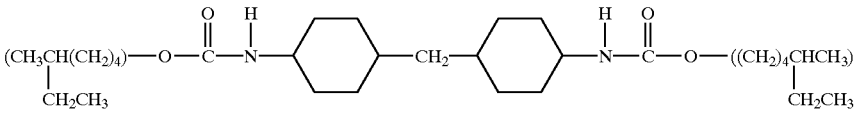
I-14
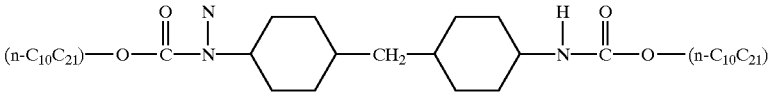
I-15
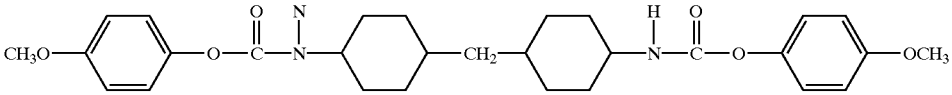
I-16
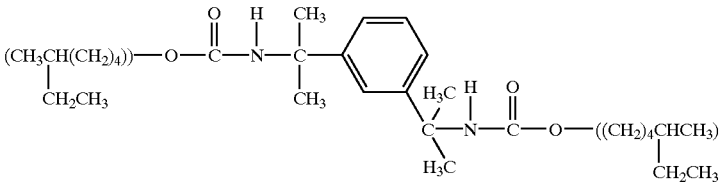

-continued
I-17
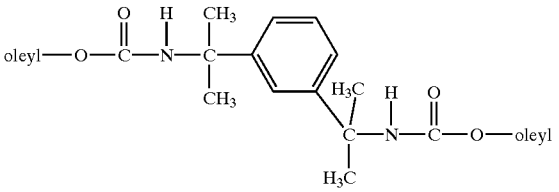
I-18
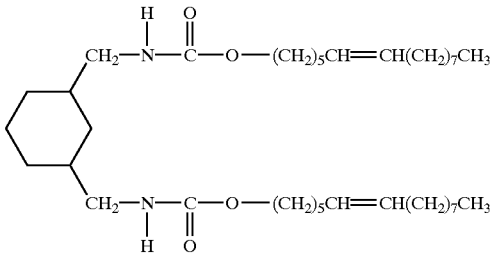
I-19
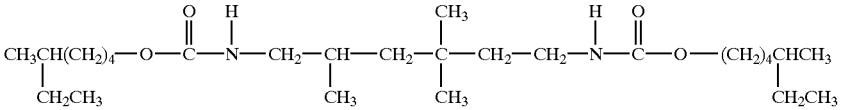
I-20
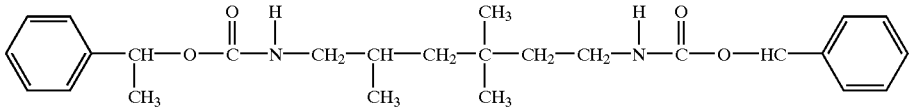
I-21
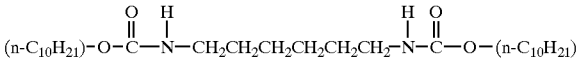
I-22
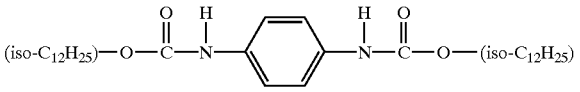
I-23
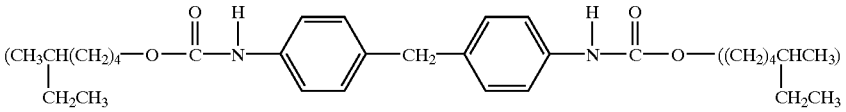
I-24
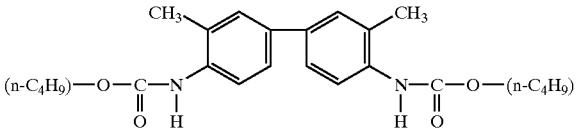
I-25
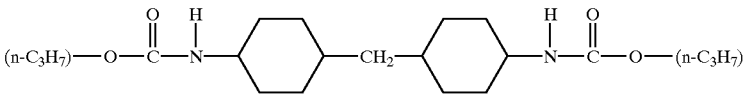
I-26
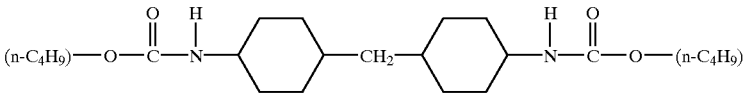
I-27
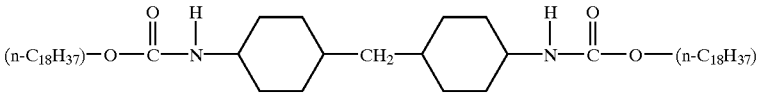

-continued

I-28

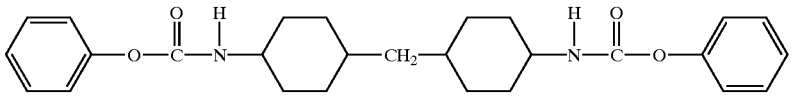

I-29

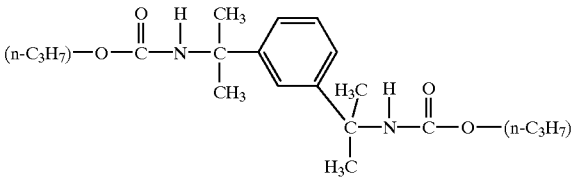

I-30

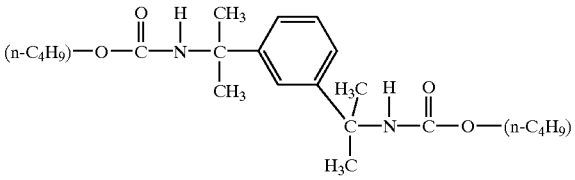

I-31

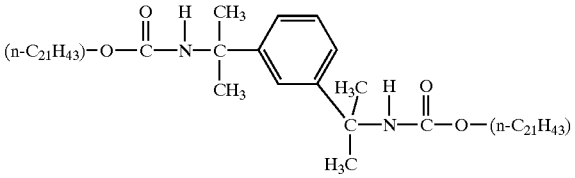

I-32

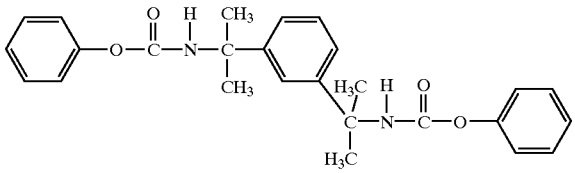

Typically, couplers and the stabilizers with which they are associated are dispersed in the same layer of the photographic element in a permanent high boiling organic compound known in the art as a coupler solvent, either alone or with auxiliary low boiling or water miscible solvents which are removed after dispersion formation. Permanent high boiling solvents have a boiling point sufficiently high, generally above 150° C. at atmospheric pressure, such that they are not evaporated under normal dispersion making and photographic layer coating procedures. Alternatively, the couplers and stabilizers may be dispersed without permanent high boiling solvents using only auxiliary solvent or precipitation techniques as is known in the art. The compounds may be co-dispersed, or may be dispersed separately and then combined. Representative conventional coupler solvents include phthalic acid alkyl esters such as diundecyl phthalate, dibutyl phthalate, bis-2-ethylhexyl phthalate, and dioctyl phthalate, phosphoric acid esters such as tricresyl phosphate, diphenyl phosphate, tris-2-ethylhexyl phosphate, and tris-3,5,5-trimethylhexyl phosphate, citric acid esters such as tributyl acetylcitrate, tributylcitrate and trihexylcitrate, 2-(2-Butoxyethoxy)ethyl acetate, and 1,4-Cyclohexyldimethylene bis(2-ethylhexanoate), benzoic acid esters such as octyl benzoate, aliphatic amides such as N,N-diethyl lauramide, N,N-Diethyldodecanamide, N,N-Dibutyldodecanamide, mono and polyvalent alcohols such as oleyl alcohol and glycerin monooleate, and alkyl phenols such as p-dodecyl phenol and 2,4-di-t-butyl or 2,4-di-t-pentyl phenol. Commonly used coupler solvents are the phthalate esters, which can be used alone or in combination with one another or with other coupler solvents. Selection of the particular coupler solvent has been found to have an influence on the activity of the coupler as well as the hue and stability of the dye formed on coupling. In accordance with certain embodiments, the compounds of Formula I may be advantageously used to partly or totally replace conventional high boiling solvents in dispersing the acetanilide-based yellow dye-forming couplers in the photographic elements of the invention.

Typically the amount of compound I used will range from about 0.05 to about 4.0 moles per mole of coupler, preferably from about 0.1 to 2.5 moles per mole of coupler. The yellow coupler is typically coated in the element at a coverage of from 0.25 mmol/$m^2$ to 2.0 mmol/$m^2$, and preferably at a coverage of from 0.40 to 1.2 mmol/$m^2$. When a conventional permanent coupler solvent is employed, it typically is present in an amount of 0.1 to 5.0 mg/mg coupler, and preferably in an amount of 0.25 to 2.0 mg/mg coupler.

To further enhance the stability of the yellow dyes formed in photographic elements in accordance with the invention, additional conventional stabilizing compounds may also be included. In accordance with a particularly preferred embodiment, the use of compounds of Formula I in combination with conventional substituted phenolic yellow dye stabilizers, and in particular substituted bisphenol based stabilizers, have been found to unexpectedly provide beneficial combinations of yellow formed dye light stability and good pressure sensitivity.

Substituted bisphenol light stabilizer compounds which may be used in accordance with preferred embodiments of the invention generally comprise bisphenol derivatives having two linked phenol rings wherein at least one of the phenol rings is substituted as described in the references cited above. Preferably, at least one of the phenolic hydroxy groups is also substituted with a blocking group. Such preferred blocked bisphenolic compounds are preferably of the following Formula II:

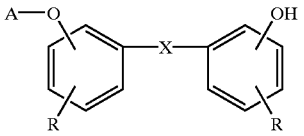

wherein A represents an alkyl (e.g., methyl, ethyl, propyl or butyl), cycloalkyl (e.g., cyclohexyl), alkenyl, aryl (e.g., phenyl), acyl (e.g., acetyl or benzoyl), alkylsulfonyl or arylsulfonyl substituent group, X represents a single bond or a bivalent linking group (e.g., an alkylidene group such as methyline, butylidine, or 3,3,5-trimethylhexylidene, or a heteroatom such as oxygen, sulfur, selenium, or tellurium, or a sulfonyl or phosphinyl group), and each R independently represents one or more alkyl, alkenyl, cycloalkyl, or aryl substituent group, such as described for A above, or in combination with the benzene ring to which it is attached represents the atoms necessary to complete a fused ring system. Each A, X and R substituent or linking group may be further substituted or unsubstituted. Specific examples of such blocked bisphenolic compounds, along with synthesis techniques, are disclosed, e.g., in U.S. Pat. Nos. 4,782,011 and 5,426,021, the disclosures of which are incorporated herein by reference. Additional substituted phenolic stabilizers which may be advantageously used in combination with the invention include those described in U.S. Pat. Nos. 5,091,294, 5,284,742, 5,935,773 and EP 0 310 551 and EP 0 310 552. When used in combination with compounds of the Formula I, the substituted phenolic stabilizers may be used at similar concentrations. Preferably, the molar ratio of compound of Formula I to substituted phenolic light stabilizer compound is from 1:12 to 25:1. The compounds of Formula I may also be used in combination with thiomorpholine compounds as described in copending, commonly assigned U.S. Ser. No. 09/483,396 incorporated by reference above. While it is an advantage of the invention that improved light stability may obviate the need for polymeric latex materials as light stabilizers, they may also be incorporated if desired. Specifically, the polymer latex materials as described in U.S. Pat. No. 5,981,159 may be employed.

Image dye forming couplers that form cyan dyes upon reaction with oxidized color developing agents may be included in elements of the invention, such as are described in representative patents and publications such as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

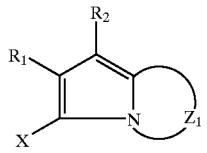

CYAN-2

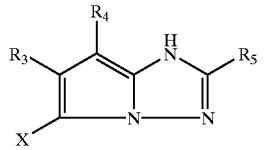

CYAN-3

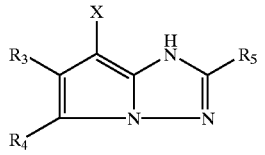

CYAN-4

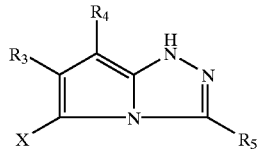

CYAN-5

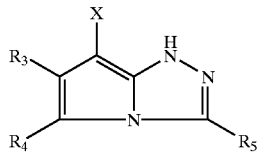

CYAN-6

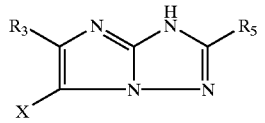

wherein $R_1$ and $R_5$ each represent a hydrogen or a substituent; $R_2$ represents a substituent; $R_3$ and $R_4$ each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —N—, —CH(R)—, etc., that preferably has a pKa value of from 3 to 12 in water. The values for Hammett's substituent constants can be found or measured as is described in the literature. For example, see C. Hansch and A. J. Leo, *J Med. Chem.,* 16, 1207 (1973); *J Med. Chem.,* 20, 304 (1977); and J. A. Dean, *Lange's Handbook of Chemistry,* 12th Ed. (1979) (McGraw-Hill).

More preferable are cyan couplers of the following formulas:

CYAN-7

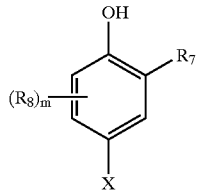

CYAN-8

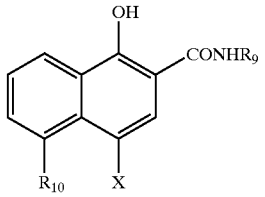

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

Image dye forming couplers that form magenta dyes upon reaction with oxidized color developing agents may be included in elements of the invention, such as are described in representative patents and publications such as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Typical pyrazoloazole and pyrazolone couplers are represented by the following formulas:

MAGENTA-1

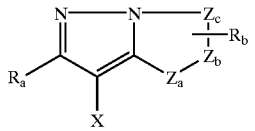

MAGENTA-2

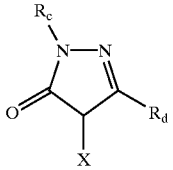

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

To obtain a satisfactory color and tonal balance as photographic images fade on exposure to light, it is important to achieve a balanced rate of density loss from yellow, magenta and cyan dyes. It is particularly desirable to produce a balanced rate of yellow and magenta dye loss in order to maintain a pleasing reproduction of skin tones. In accordance with preferred embodiments of the invention, a balanced rate of fade can be achieved using a yellow dye-forming layer comprising a stabilizer combination in accordance with preferred embodiments of this invention in combination with a magenta dye-forming coupler layer comprising highly-stable pyrazolotriazole coupler.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercapto propionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Photographic elements of this invention can have the structures and components shown on Research Disclosure, February 1995, Item 37038, pages 79–114. Research Disclosure is published by Kenneth Mason Publications, Ltd., Dudley Annex, 12a North Street, Emsworth, Hampshire P010 7DQ, ENGLAND. Specific elements can be those shown on pages 96–98 of this Research Disclosure item as Color Paper Elements 1 and 2, in which is employed in the yellow dye forming layers the stabilizer combinations of the present invention instead of the stabilizers shown there. A typical multicolor photographic element of this invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

This invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1994, Number 365, Item 36544, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as developer inhibitor releasing compounds (DIR's).

The elements of the present invention may be employed to obtain reflection color prints as described in *Research Disclosure,* November 1979, Item 18716, incorporated herein by reference. The emulsions and materials to form elements of the present invention, may be coated on pH adjusted support as described in U.S. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Patent Applications 83/09,959; 83/62,586; 90/072,629, 90/072,630; 90/072,632; 90/072,633; 90/072,634; 90/077,822; 90/078,229; 90/078,230; 90/079,336; 90/079,338; 90/079,690; 90/079,691; 90/080,487; 90/080,489; 90/080,490; 90/080,491; 90/080,492; 90/080,494; 90/085,928; 90/086,669; 90/086,670; 90/087,361; 90/087,362; 90/087,363; 90/087,364; 90/088,096; 90/088,097; 90/093,662; 90/093,663; 90/093,664; 90/093,665; 90/093,666; 90/093,668; 90/094,055; 90/094,056; 90/101,937; 90/103,409; 90/151,577.

The silver halide emulsion grains to be used in the invention may be prepared according to methods known in the art, such as those described in *Research Disclosure I* and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure,* June 1975, item 13452 and U.S. Pat. No. 3,772,031.

The silver halide may be sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor, *The Theory of the Photographic Process,* 4th Edition, Macmillan, N.Y., 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are: 4-amino-N,N-diethylaniline hydrochloride, 4-amino-3-methyl-N,N-diethylaniline hydrochloride, 4-amino-3-methyl-N-ethyl-N-(b-(methanesulfonamido)ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The photographic elements comprising stabilizers in accordance with this invention may be processed in amplification processes that use developer/amplifier solutions described in U.S. Pat. No. 5,324,624, for example. When processed in this way, the low volume, thin tank processing system and apparatus described in U.S. Pat. No. 5,436,118 preferably is employed.

EXAMPLES

The following examples further illustrate this invention. In such examples, acetanilide-based yellow couplers of the above structures YC-1, YC-2 and YC-18 are employed. Also, in addition to various compounds of Formula I above, yellow stabilizers YSt-1 through YSt-9 are employed:

YSt-1
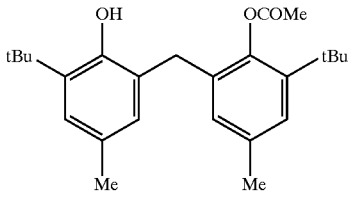
YSt-2
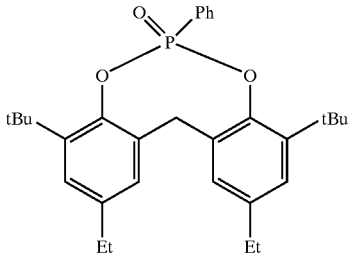
YSt-3
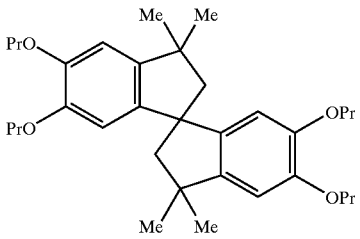
YSt-4
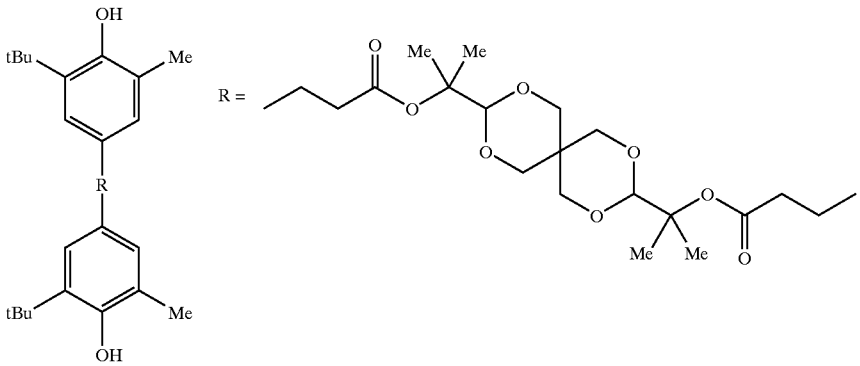
YSt-5
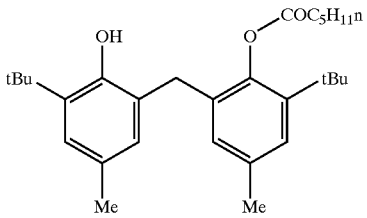

-continued
YSt-6
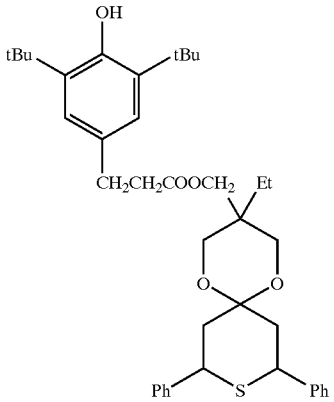
YSt-7
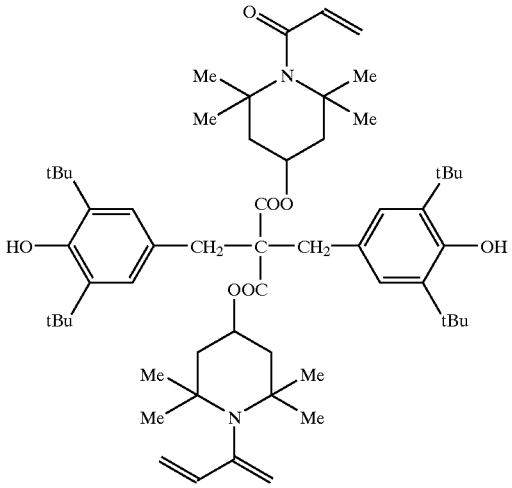
YSt-8
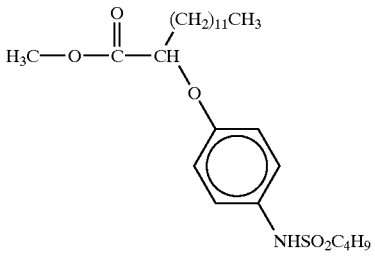
YSt-9
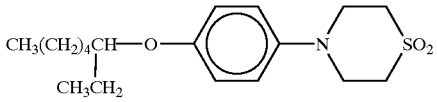

Conventional coupler solvents used in the examples are the following:

CS-1

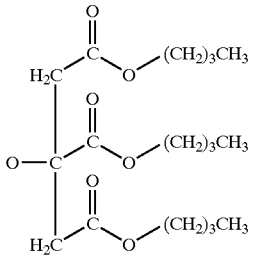

CS-2

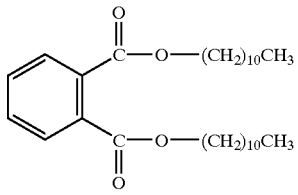

CS-3

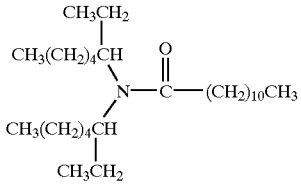

CS-4

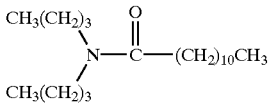

CS-5

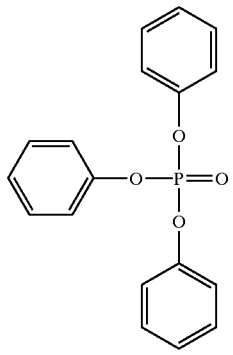

CS-6

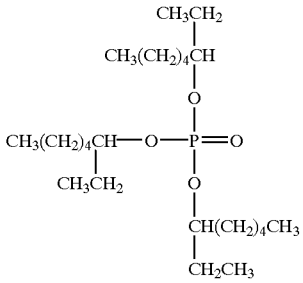

CS-7

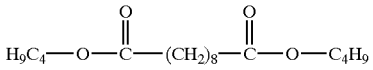

CS-8 $CH_3(CH_2)_7CH{=}CH(CH_2)_8{-}OH$

The compounds of Formula I are in general significantly more viscous than conventional permanent coupler solvents such as CS-1 and CS-2. While high viscosity compounds of Formula I would be difficult to pump and pour in large-scale manufacturing, such compounds may be blended with low viscosity conventional solvents such as CS-1 to result in a more manageable viscosity as indicated in the following table:

| Compound | R | Viscosity (cP) (at 25° C.) | Viscosity (cP) 50/50 wt % Blend with CS-1 |
|---|---|---|---|
| CS-1 | — | 25 | — |
| CS-2 | — | 50 | — |
| I-1 | $C_6H_{13}$ | 260,000 | 310 |
| I-2 | $C_8H_{17}$ | 165,000 | 336 |
| I-3 | $C_9H_{19}$ | 90,000 | 354 |
| I-4 | $C_{10}H_{21}$ | 76,000 | 298 |
| I-5 | $C_{12}H_{25}$ | 9,500 | 230 |
| I-6 | $C_{14}H_{29}$ | 5,700 | 192 |

Example 1

Coupler dispersion 1-1 was prepared by dissolving 15.8 g of coupler YC2 and 4.6 g of stabilizer YSt-4 in 8.3 g of solvent CS-1 at 110° C. An aqueous gelatin solution of 17.5 g gelatin, 112.0 g water, 1.7 g propionic acid (2N), and 15.1 g of a 10% aqueous solution of surfactant Alkanol-XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 75° C.

Dispersions 1-2 through 1-17 were similarly prepared except that the solvent CS-1 was either partially or completely replaced with a compound of Formula I or other comparative solvent, or blends thereof, as according to the table below. The amounts of the other components in the oil phase were unaltered, and water was adjusted to maintain a total dispersion amount of 175.0 g.

Dispersions 1-18 through 1-21 were prepared as Dispersion 1-1 except that 2.3 g of stabilizer YSt-9 was added to the oil phase and the solvent CS-1 was either partially or completely replaced with a compound of Formula I or another comparative solvent, as according to Table 1 below. The amounts of the other components in the oil phase were unaltered, and water was adjusted to maintain a total dispersion amount of 175.0 g.

TABLE 1

| Dispersions 1-1 through 1-21 | | | |
|---|---|---|---|
| Dispersion | Solvent(s) | Amount(s) | |
| 1-1 | CS-1 | 8.3 g | Comparison |
| 1-2 | CS-2 | 8.3 g | Comparison |
| 1-3 | I-3 | 8.3 g | Invention |
| 1-4 | I-5 | 8.3 g | Invention |
| 1-5 | I-6 | 8.3 g | Invention |
| 1-6 | I-7 | 8.3 g | Invention |
| 1-7 | I-8 | 8.3 g | Invention |
| 1-8 | I-9 | 8.3 g | Invention |
| 1-9 | CS-1 | 16.6 g | Comparison |
| 1-10 | CS-2 | 16.6 g | Comparison |
| 1-11 | I-5 | 16.6 g | Invention |
| 1-12 | I-6 | 16.6 g | Invention |
| 1-13 | I-6/CS-1 | 8.3 g/8.3 g | Invention |
| 1-14 | I-8 | 16.6 g | Invention |
| 1-15 | I-5 | 24.9 g | Invention |

TABLE 1-continued

| Dispersions 1-1 through 1-21 | | | |
|---|---|---|---|
| Dispersion | Solvent(s) | Amount(s) | |
| 1-16 | I-6 | 24.9 g | Invention |
| 1-17 | I-8 | 24.9 g | Invention |
| 1-18 | CS-1 | 8.3 g | Comparison |
| 1-19 | I-5 | 8.3 g | Invention |
| 1-20 | I-6 | 8.3 g | Invention |
| 1-21 | I-8 | 8.3 g | Invention |

Each of these coupler dispersions was diluted with further aqueous gelatin and mixed with a blue-sensitive cubic silver iodo-chloride photographic emulsion (average edge length: 0.76 $\mu$m) for coating on a resin-coated paper support, pre-coated with an unhardened gel pad. The mixing of the already molten components was carried out immediately prior to coating. The full coating structure is shown below. Individual solvent and stabilizer coverages in the photosensitive layer for the various coatings are either reported in Table 2 or are defined by the dispersion identity. Many of the dispersions were also coated in a modification of the coating format in which a 44 nm t-butylacrylamide/butylacrylate 50/50 copolymer latex (P-1) was included in the photosensitive layer, as noted in Table 2 below.

| Coating Structure | |
|---|---|
| GEL SUPERCOAT | |
| Gelatin | 1.077 g.m$^{-2}$ |
| Hardener* | 0.149 g.m$^{-2}$ |
| Coating Surfactants | |
| UV LAYER | |
| Gelatin | 1.399 g.m$^{-2}$ |
| Tinuvin-328 ® | 0.510 g.m$^{-2}$ |
| Tinuvin-326 ® | 0.090 g.m$^{-2}$ |
| Dioctyl hydroquinone | 0.193 g.m$^{-2}$ |
| CS-6 | 0.235 g.m$^{-2}$ |
| PHOTOSENSITIVE LAYER | |
| Gelatin | 1.402 g.m$^{-2}$ |
| Coupler YC2 | 0.414 g.m$^{-2}$ |
| YSt-4 | 0.121 g.m$^{-2}$ |

-continued

| Coating Structure | |
|---|---|
| Coupler solvent | as specified by Table 2 below |
| YSt-9 | as specified by Table 2 below |
| Latex P-1 | as specified by Table 2 below |
| PHR** | 0.0024 g.m$^{-2}$ |
| Ag Halide emulsion | 0.210 g.m$^{-2}$ (as Ag) |
| GEL PAD | |
| Gelatin | 3.230 g.m$^{-2}$ |
| Resin Coated Paper | |

*Hardener = bis(vinylsulphonylmethane)
**PHR = 2,5-dihydroxy-5-methyl-3-(1-piperidenyl)-2-cyclopenten-1-one Sample strips of the coatings were exposed through a step tablet (density range 0–3, 0.15 increments) and developed in standard Kodak RA4 processing solutions before washing and drying. Sensitometric curves were generated for each processed strip. In table 2, coupling reactivity is represented by the figures in column 2, headed "Shoulder", which is used as a convenient monitor of upper scale contrast. It is obtained by recording the density achieved at an exposure 0.4 log(exposure) units greater than that required to produce a density of 0.8. The maximum density achieved, Dmax, is also reported for each coating. Higher shoulder and Dmax values correspond to greater reactivity.

The image dye light stability was assessed using simulated daylight fading equipment incorporating a Xenon arc source, delivering an exposure intensity of 50 Klux at the sample plane. At the end of these tests, the densities of the sample strips were re-measured and compared with the initial curves. Status "A" blue density changes from an initial density value of 1.0 after 3 and 5 weeks treatment are recorded in the table 2 below as HID3W10 and HID5W10, respectively.

An absorption spectra was measured for each coating from 380 nm to 750 nm and were normalized by the density at the wavelength of maximum density for the yellow dye ($\lambda$max). A measure of the purity of the yellow dye is represented by the density of the normalized spectra at 500 nm, reported as ABS500. The lower the density, the less unwanted green light absorption.

TABLE 2

Photographic Results on Coatings 101 through 137

| Ctg | Disp | Solvent | Solvent Laydown (g.m$^{-2}$) | YSt-9 (g.m$^{-2}$) | Latex P-1 (g.m$^{-2}$) | Shldr | DMAX | HID3 W10 | HID5 W10 | $\lambda$max | ABS-500 |
|---|---|---|---|---|---|---|---|---|---|---|---|
| 101 Comp. | 1-1 | CS-1 | 0.218 | — | 0.484 | 1.67 | 2.09 | −0.22 | −0.45 | 446 | 0.522 |
| 102 Comp. | 1-1 | CS-1 | 0.218 | — | — | 1.67 | 2.06 | −0.42 | −0.78 | 450 | 0.544 |
| 103 Comp. | 1-2 | CS-2 | 0.218 | — | 0.484 | 1.68 | 2.08 | −0.28 | −0.54 | 448 | 0.51 |
| 104 Comp. | 1-2 | CS-2 | 0.218 | — | — | 1.68 | 2.04 | −0.60 | −0.81 | 448 | 0.543 |
| 105 Inv. | 1-3 | I-3 | 0.218 | — | 0.484 | 1.59 | 2.01 | −0.19 | −0.39 | 446 | 0.515 |
| 106 Inv. | 1-3 | I-3 | 0.218 | — | — | 1.60 | 1.97 | −0.28 | −0.62 | 446 | 0.53 |
| 107 Inv. | 1-4 | I-5 | 0.218 | — | 0.484 | 1.60 | 2.02 | −0.21 | −0.42 | 446 | 0.511 |

TABLE 2-continued

Photographic Results on Coatings 101 through 137

| Ctg | Disp | Solvent | Solvent Laydown ($g.m^{-2}$) | YSt-9 ($g.m^{-2}$) | Latex P-1 ($g.m^{-2}$) | Shldr | DMAX | HID3 W10 | HID5 W10 | λmax | ABS-500 |
|---|---|---|---|---|---|---|---|---|---|---|---|
| 108 Inv. | 1-4 | I-5 | 0.218 | — | — | 1.59 | 1.99 | −0.33 | −0.71 | 446 | 0.535 |
| 109 Inv. | 1-5 | I-6 | 0.218 | — | 0.484 | 1.62 | 2.05 | −0.21 | −0.43 | 448 | 0.515 |
| 110 Inv. | 1-5 | I-6 | 0.218 | — | — | 1.63 | 2.01 | −0.35 | −0.71 | 446 | 0.53 |
| 111 Inv. | 1-6 | I-7 | 0.218 | — | — | 1.63 | 2.01 | −0.35 | −0.72 | 450 | 0.525 |
| 112 Inv. | 1-7 | I-8 | 0.218 | — | 0.484 | 1.64 | 2.05 | −0.19 | −0.40 | 448 | 0.518 |
| 113 Inv. | 1-7 | I-8 | 0.218 | — | — | 1.63 | 2.02 | −0.37 | −0.75 | 448 | 0.536 |
| 114 Inv. | 1-8 | I-9 | 0.218 | — | — | 1.63 | 2.03 | −0.37 | −0.74 | 446 | 0.534 |
| 115 Comp. | 1-9 | CS-1 | 0.436 | — | 0.484 | 1.73 | 2.16 | −0.26 | −0.56 | 448 | 0.519 |
| 116 Comp. | 1-9 | CS-1 | 0.436 | — | — | 1.73 | 2.15 | −0.56 | −0.82 | 446 | 0.536 |
| 117 Comp. | 1-10 | CS-2 | 0.436 | — | 0.484 | 1.70 | 2.11 | −0.45 | −0.73 | 446 | 0.51 |
| 118 Comp. | 1-10 | CS-2 | 0.436 | — | — | 1.72 | 2 12 | −0.72 | −0.83 | 448 | 0.538 |
| 119 Inv. | 1-11 | I-5 | 0.436 | — | 0.484 | 1.62 | 2.06 | −0.16 | −0.37 | 448 | 0.507 |
| 120 Inv. | 1-11 | I-5 | 0.436 | — | — | 1.61 | 2.04 | −0.26 | −0.61 | 450 | 0.528 |
| 121 Inv. | 1-12 | I-6 | 0.436 | — | 0.484 | 1.62 | 2.04 | −0.19 | −0.41 | 448 | 0.51 |
| 122 Inv. | 1-12 | I-6 | 0.436 | — | — | 1.62 | 2.02 | −0.29 | −0.67 | 446 | 0.524 |
| 123 Inv. | 1-13 | I-6/ CS-1 | 0.218/ 0.218 | — | 0.484 | 1.69 | 2.13 | −0.19 | −0.43 | 446 | 0.503 |
| 124 Inv. | 1-13 | I-6/ CS-1 | 0.218/ 0.218 | — | — | 1.71 | 2.12 | −0.34 | −0.76 | 446 | 0.526 |
| 125 Inv. | 1-14 | I-8 | 0.436 | — | 0.484 | 1.64 | 2.08 | −0.22 | −0.47 | 448 | 0.508 |
| 126 Inv. | 1-14 | I-8 | 0.436 | — | — | 1.62 | 2.05 | −0.32 | −0.71 | 450 | 0.525 |
| 127 Inv. | 1-15 | I-5 | 0.654 | — | — | 1.60 | 2.04 | −0.23 | −0.56 | 450 | 0.523 |
| 128 Inv. | 1-16 | I-6 | 0.654 | — | — | 1.63 | 2.06 | −0.28 | −0.67 | 446 | 0.514 |
| 129 Inv. | 1-17 | I-8 | 0.654 | — | — | 1.65 | 2.07 | −0.32 | −0.71 | 448 | 0.513 |
| 130 Comp. | 1-18 | CS-1 | 0.218 | 0.061 | 0.355 | 1.69 | 2.10 | −0.19 | −0.40 | 446 | 0.529 |
| 131 Comp. | 1-18 | CS-1 | 0.218 | 0.061 | — | 1.69 | 2.08 | −0.30 | −0.67 | 448 | 0.542 |
| 132 Inv. | 1-19 | I-5 | 0.218 | 0.061 | 0.355 | 1.62 | 2.05 | −0.15 | −0.32 | 450 | 0.518 |
| 133 Inv. | 1-19 | I-5 | 0.218 | 0.061 | — | 1.65 | 2.05 | −0.21 | −0.46 | 446 | 0.537 |
| 134 Inv. | 1-20 | I-6 | 0.218 | 0.061 | 0.355 | 1.65 | 2.05 | −0.15 | −0.32 | 446 | 0.519 |
| 135 Inv. | 1-20 | I-6 | 0.218 | 0.061 | — | 1.62 | 2.03 | −0.23 | −0.50 | 448 | 0.541 |
| 136 Inv. | 1-21 | I-8 | 0.218 | 0.061 | 0.355 | 1.65 | 2.08 | −0.15 | −0.33 | 446 | 0.523 |
| 137 Inv. | 1-21 | I-8 | 0.218 | 0.061 | — | 1.64 | 2.04 | −0.23 | −0.51 | 448 | 0.529 |

The dye formed from yellow coupler YC-2 in coating 101 is stabilized to light using stabilizer YSt-4 and latex P-1. Removal of latex P-1 in coating 102 results in more light fade, as well as increased unwanted green light absorption. The use of comparison solvent CS-2 in place of CS-1 results in more density loss, comparing 103 to 101 and 104 to 102, whereas replacement of CS-1 with the compounds of Formula I in accordance with the invention results in improved light stability, shown for example by comparison of 112 to 101 and 113 to 102. The coatings which contain the compounds of Formula I but not latex P-1 are improved over comparison coating 102. Examination of the data for coating 105 through 114 shows that better light stability is achieved through the use of the Formula I compounds with shorter carbon chain-lengths. The compounds of Formula I also provide less unwanted green light absorption than CS-1.

Increasing the levels of the comparison solvents CS-1 and CS-2 results in more fade, as observed in comparison of coatings 115 through 118 to 101 through 104, respectively.

Use of the compounds of Formula I in accordance with the invention at increased laydown, specifically twice and three times the amounts in coatings 105 through 114 yields improved light stability. Compare coatings 119–122, 125–129 with coatings 107–110, 112, 113. Coating 127, utilizing I-5, has light stability and unwanted green absorption very similar to coating 101, without the use of latex P-1, although its activity is lower as shown by comparison of the shoulder and Dmax values for these coatings.

The activity of the coupler is reduced where the compounds of Formula I are employed in comparison to solvent CS-1. Increasing the amounts of the comparison solvents increases the activity, but increasing the amounts of the compounds of Formula I further reduces the activity of the coupler. Comparison of coatings 115, 123, 121 and 116, 124, 122 shows that a 50:50 blend of the compound I-6 with comparison solvent CS-1 maintains the activity of the coupler as when only the comparison solvent is used, but the light stability is closer to that of using only the compound of Formula I. Thus, blending the compounds of Formula I with the comparison solvents enables both light stability improvements and maintenance of the coupler's activity.

Coatings 130 through 137 show that further light stability improvements can be achieved through the combination of the compounds of Formula I with stabilizer YSt-9, whether latex P-1 is present or not.

Example 2

Dispersion 2-1 was prepared like Dispersion 1-1.

Dispersion 2-2 was prepared by dissolving 90.2 g of coupler YC2, 13.2 g of stabilizer YSt-9, and 26.4 g of stabilizer YSt-1 in 47.4 g of solvent CS-1 at 110° C. An aqueous gelatin solution of 100.0 g gelatin, 627.0 g water, 9.8 g propionic acid (2N), and 86.0 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 75° C.

Dispersion 2-3 was prepared by dissolving 15.8 g of coupler YC2, 2.3 g of stabilizer YSt-9, and 4.6 g of stabilizer YSt-1 in 8.3 g of solvent CS-3 at 110° C. An aqueous gelatin solution of 17.5 g gelatin, 109.7 g water, 1.7 g propionic acid (2N), and 15.1 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 75° C.

Dispersion 2-4 was prepared as Dispersion 2-3, except replacing solvent CS-1 with solvent CS-4.

Dispersion 2-5 was prepared as Dispersion 2-3, except replacing solvent CS-1 with solvent CS-5.

Dispersion 2-6 was prepared by dissolving 12.5 g of coupler YC2, 1.8 g of stabilizer YSt-9, and 3.6 g of stabilizer YSt-1 in 13.1 g of solvent CS-1 at 110° C. An aqueous gelatin solution of 17.5 g gelatin, 109.7 g water, 1.7 g propionic acid (2N), and 15.1 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 75° C.

Dispersions 2-7 through 2-20 were prepared as Dispersion 2-6, except that the solvent CS-1 was either partially or completely replaced with the compounds of Formula I, as according to Table 3 below.

Dispersion 2-21 was prepared by dissolving 15.8 g of coupler YC1, 2.3 g of stabilizer YSt-9, and 4.6 g of stabilizer YSt-1 in 8.3 g of solvent CS-1 at 110° C. An aqueous gelatin solution of 17.5 g gelatin, 109.7 g water, 1.7 g propionic acid (2N), and 15.1 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 75° C.

Dispersions 2-22 through 2-24 were prepared as Dispersion 2-21 except that solvent CS-1 was either partially or completely replaced with the compounds of Formula I, as according to Table 3 below.

TABLE 3

Dispersions 2-1 through 2-24

| Disp | Coupler | Stabilizer(s) | Solvent 1 | Solvent 1: Coupler | Solvent 2 | Solvent 2: Coupler |
|---|---|---|---|---|---|---|
| 2-1 | YC2 | YSt-4 | CS-1 | 0.526 | | |
| 2-2 | YC2 | YSt-1/ YSt-9 | CS-1 | 0.526 | | |
| 2-3 | YC2 | YSt-1/YSt-9 | CS-3 | 0.526 | | |
| 2-4 | YC2 | YSt-1/YSt-9 | CS-4 | 0.526 | | |
| 2-5 | YC2 | YSt-1/ YSt-9 | CS-5 | 0.526 | | |
| 2-6 | YC2 | YSt-1/YSt-9 | CS-1 | 1.052 | | |
| 2-7 | YC2 | YSt-1/YSt-9 | I-1 | 1.052 | | |
| 2-8 | YC2 | YSt-1/ YSt-9 | I-2 | 1.052 | | |
| 2-9 | YC2 | YSt-1/YSt-9 | I-4 | 1.052 | | |
| 2-10 | YC2 | YSt-1/YSt-9 | I-5 | 1.052 | | |
| 2-11 | YC2 | YSt-1/ YSt-9 | I-6 | 1.052 | | |
| 2-12 | YC2 | YSt-1/YSt-9 | I-1 | 0.526 | CS-1 | 0.526 |
| 2-13 | YC2 | YSt-1/YSt-9 | I-2 | 0.526 | CS-1 | 0.526 |
| 2-14 | YC2 | YSt-1/YSt-9 | I-3 | 0.526 | CS-1 | 0.526 |
| 2-15 | YC2 | YSt-1/ YSt-9 | I-4 | 0.526 | CS-1 | 0.526 |
| 2-16 | YC2 | YSt-1/YSt-9 | I-5 | 0.526 | CS-1 | 0.526 |
| 2-17 | YC2 | YSt-1/YSt-9 | I-6 | 0.526 | CS-1 | 0.526 |
| 2-18 | YC2 | YSt-1/ YSt-9 | I-2 | 0.789 | CS-1 | 0.263 |
| 2-19 | YC2 | YSt-1/YSt-9 | I-5 | 0.263 | CS-1 | 0.789 |
| 2-20 | YC2 | YSt-1/YSt-9 | I-5 | 0.789 | CS-1 | 0.263 |
| 2-21 | YC1 | YSt-1/YSt-9 | CS-1 | 0.526 | | |
| 2-22 | YC1 | YSt-1/ YSt-9 | I-5 | 0.263 | CS-1 | 0.263 |
| 2-23 | YC1 | YSt-1/YSt-9 | I-5 | 0.526 | | |
| 2-24 | YC1 | YSt-1/YSt-9 | I-2 | 0.526 | | |

Dispersion 2-25 was prepared by dissolving 36.0 g of compound I-1 with 36.0 g ethyl acetate at 50° C. An aqueous gelatin solution of 18.0 g gelatin, 197.6 g water, 0.4 g 0.7% solution of Kathon LX, and 12.0 g of a 10% aqueous solution of surfactant Alkanol XC was prepared at 50° C. The oil phase was mixed with the aqueous gelatin solution for 2 minutes at 5000 rpm using a Silverson rotor-stator mixer. This mixture was then passed five times through a Gaulin colloid mill. The ethyl acetate was evaporated using a rotary evaporator for 8 minutes at a temperature of 75° C. This dispersion may be referred to as a solvent "blank" dispersion of compound I-1.

Dispersion 2-26 was prepared as 2-25, except replacing compound I-1 with I-2.

Dispersion 2-27 was prepared as 2-25, except replacing compound I-1 with I-3.

Dispersion 2-28 was prepared as 2-25, except replacing compound I-1 with I-4.

Dispersion 2-29 was prepared as 2-25, except replacing compound I-1 with I-5.

Dispersion 2-30 was prepared as 2-25, except replacing compound I-1 with I-6.

The solvent "blank" dispersions 2-25 through 2-30 were melted together with Dispersion 2-2 to evaluate delivering the compound of Formula I in accordance with the invention from a separate dispersion compared with combining the compound with the coupler directly in the oil phase as in Dispersions 2-7 through 2-25.

Each of these coupler dispersions was coated in a coating structure similar to that employed in Example 1, except the silver halide emulsion was coated at 0.215 g/m$^2$ (as Ag) in the photosensitive layer, as modified by the dispersions employed, with individual coupler, solvent and stabilizer coverages in the photosensitive layer for each coating being either reported in Table 4 or defined by the dispersion identity. The photosensitive layer for Coating 201 additionally comprised 0.0095 g/m$^2$ HQ-K (2,5-dihydroxy-4-(1-methylheptadecyl)-benzenesulphonic acid (K salt)). Sample strips of the coatings were exposed, processed, and evaluated as in Example 1, and results are reproduced in Table 4.

TABLE 4

Photographic Responses for Coatings 201–234*

| Ctg | Disp | Solvent | Solvent Ldwn (g.m$^{-2}$) | Solvent Blank (Disp. #) | Blank Ldwn (g.m$^{-2}$) | Latex P-1 (g.m$^{-2}$) | Shldr | Dmax | 3W Fade From 1.0 | 5W Fade From 1.0 | ABS 500 |
|---|---|---|---|---|---|---|---|---|---|---|---|
| 201 Comp. | 2-1 | CS-1 | 0.218 | | | 0.484 | 1.809 | 2.094 | −0.261 | −0.514 | 0.519 |
| 202 Comp. | 2-2 | CS-1 | 0.218 | | | 0.178 | 1.878 | 2.215 | −0.152 | −0.352 | 0.518 |
| 203 Comp. | 2-2 | CS-1 | 0.218 | | | 0 | 1.880 | 2.213 | −0.185 | −0.461 | 0.533 |
| 204 Comp. | 2-3 | CS-3 | 0.218 | | | 0.178 | 1.864 | 2.192 | −0.189 | −0.484 | 0.533 |
| 205 Comp. | 2-4 | CS-4 | 0.218 | | | 0.178 | 1.896 | 2.212 | −0.217 | −0.528 | 0.51 |
| 206 Comp. | 2-5 | CS-5 | 0.218 | | | 0 | 1.823 | 2.116 | −0.206 | −0.538 | 0.541 |
| 207 Comp. | 2-6 | CS-1 | 0.436 | | | 0 | 1.890 | 2.236 | −0.162 | −0.439 | 0.535 |
| 208 Inv. | 2-7 | I-1 | 0.436 | | | 0 | 1.802 | 2.112 | −0.121 | −0.249 | 0.517 |
| 209 Inv. | 2-8 | I-2 | 0.436 | | | 0 | 1.791 | 2.096 | −0.144 | −0.288 | 0.505 |
| 210 Inv. | 2-9 | I-4 | 0.436 | | | 0 | 1.795 | 2.103 | −0.134 | −0.282 | 0.512 |
| 211 Inv. | 2-10 | I-5 | 0.436 | | | 0 | 1.821 | 2.127 | −0.146 | −0.301 | 0.516 |
| 212 Inv. | 2-11 | I-6 | 0.436 | | | 0 | 1.842 | 2.138 | −0.163 | −0.342 | 0.512 |
| 213 Inv. | 2-12 | CS-1/ I-1 | 0.218/ 0.218 | | | 0 | 1.890 | 2.222 | −0.128 | −0.268 | 0.519 |
| 214 Inv. | 2-13 | CS-1/ I-2 | 0.218/ 0.218 | | | 0 | 1.870 | 2.209 | −0.124 | −0.279 | 0.527 |
| 215 Inv. | 2-14 | CS-1/ I-3 | 0.218/ 0.218 | | | 0 | 1.886 | 2.209 | −0.126 | −0.264 | 0.523 |
| 216 Inv. | 2-15 | CS-1/ I-4 | 0.218/ 0.218 | | | 0 | 1.891 | 2.203 | −0.149 | −0.323 | 0.523 |
| 217 Inv. | 2-16 | CS-1/ I-5 | 0.218/ 0.218 | | | 0 | 1.889 | 2.201 | −0.152 | −0.352 | 0.514 |
| 218 Inv. | 2-17 | CS-1/ I-6 | 0.218/ 0.218 | | | 0 | 1.896 | 2.222 | −0.168 | −0.387 | 0.518 |
| 219 Inv. | 2-18 | CS-1/ I-2 | 0.109/ 0.327 | | | 0 | 1.836 | 2.147 | −0.137 | −0.303 | 0.511 |
| 220 Inv. | 2-19 | CS-1/ I-5 | 0.327/ 0.109 | | | 0 | 1.925 | 2.219 | −0.193 | −0.464 | 0.521 |
| 221 Inv. | 2-20 | CS-1/ I-5 | 0.109/ 0.327 | | | 0 | 1.882 | 2.197 | −0.136 | −0.274 | 0.508 |
| 222 Inv. | 2-2 | CS-1 | 0.218 | I-1 (2-25) | 0.218 | 0 | 1.905 | 2.232 | −0.137 | −0.311 | 0.526 |
| 223 Inv. | 2-2 | CS-1 | 0.218 | I-2 (2-26) | 0.218 | 0 | 1.886 | 2.229 | −0.141 | −0.324 | 0.522 |
| 224 Inv. | 2-2 | CS-1 | 0.218 | I-4 (2-28) | 0.218 | 0 | 1.890 | 2.200 | −0.187 | −0.463 | 0.53 |
| 225 Inv. | 2-2 | CS-1 | 0.218 | I-6 (2-30) | 0.218 | 0 | 1.875 | 2.211 | −0.235 | −0.534 | 0.532 |
| 226 Inv. | 2-2 | CS-1 | 0.218 | I-1 (2-25) | 0.436 | 0 | 1.886 | 2.228 | −0.133 | −0.273 | 0.514 |
| 227 Inv. | 2-2 | CS-1 | 0.218 | I-2 (2-26) | 0.436 | 0 | 1.891 | 2.221 | −0.132 | −0.266 | 0.518 |
| 228 Inv. | 2-2 | CS-1 | 0.218 | I-4 (2-28) | 0.436 | 0 | 1.884 | 2.195 | −0.198 | −0.453 | 0.537 |

TABLE 4-continued

Photographic Responses for Coatings 201–234*

| Ctg | Disp | Solvent | Solvent Ldwn ($g.m^{-2}$) | Solvent Blank (Disp. #) | Blank Ldwn ($g.m^{-2}$) | Latex P-1 ($g.m^{-2}$) | Shldr | Dmax | 3W Fade From 1.0 | 5W Fade From 1.0 | ABS 500 |
|---|---|---|---|---|---|---|---|---|---|---|---|
| 229 Inv. | 2-2 | CS-1 | 0.218 | I-5 (2-29) | 0.436 | 0 | 1.882 | 2.205 | −0.217 | −0.469 | 0.529 |
| 230 Inv. | 2-2 | CS-1 | 0.218 | I-6 (2-30) | 0.436 | 0 | 1.894 | 2.204 | −0.241 | −0.514 | 0.521 |
| 231 Comp. | 2-21 | CS-1 | 0.218 | | | 0 | 1.786 | 2.034 | −0.101 | −0.18 | 0.396 |
| 232 Inv. | 2-22 | CS-1/ I-5 | 0.109/ 0.109 | | | 0 | 1.727 | 1.984 | −0.09 | −0.167 | 0.394 |
| 233 Inv. | 2-23 | I-5 | 0.218 | | | 0 | 1.650 | 1.866 | −0.087 | −0.156 | 0.389 |
| 234 Inv. | 2-24 | I-2 | 0.218 | | | 0 | 1.632 | 1.855 | −0.094 | −0.159 | 0.385 |

*201 contains YSt-4, 202–234 contain YSt-1 and YSt-9

Elements 204 and 205 contain widely known solvents with amide groups. These do not show improved light stability when used to replace CS-1 in element 202. Element 206 with solid solvent tri-phenyl phosphate did not improve light stability when replacing solvent CS-1 of element 203.

Comparison of elements 208–212 with element 207 shows that use of the compounds of Formula I improves light stability and hue, but reduced shoulder and Dmax. This deficit in shoulder and Dmax can be eliminated by blending the comparison solvent with the compound of Formula I with hardly any loss in light stability as shown in coatings 213–231. Coatings 219–221 demonstrate that the blending ratio of the comparison solvent to the compound of Formula I can be adjusted to meet reactivity and light stability requirements. Coatings 222–230 demonstrate that the compound of Formula I does not need to be co-dispersed with the coupler, but can be added to the coating solution from a separate dispersion. Increasing the laydown of the compound of Formula I improved the light stability, as observed by comparison of 226–230 to 222–225. Adding the compound of Formula I as a separate dispersion is not as effective for light stability as including the compound of Formula I in the oil phase of the coupler dispersion, but it does enable maintenance of high activity. In either mode of delivery, the compounds of Formula I with shorter chain lengths are preferred for light stability. Combination of coupler YC-1 with solvents of the invention also provide image stability improvement, as shown by coatings 232–234 relative to coating 231.

Example 3

Dispersion 3-1 was prepared by dissolving 45.1 g of coupler YC2 and 13.2 g of stabilizer YSt-4 in 23.7 g of solvent CS-1 at 110° C. An aqueous gelatin solution of 50.0 g gelatin, 320.1 g water, 4.9 g propionic acid (2N), and 43.0 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 75° C.

Dispersion 3-2 was prepared similarly to Dispersion 3-1, except that half of the solvent CS-1 was replaced with compound I-2.

Dispersion 3-3 was prepared similarly to Dispersion 3-1, except that half of the solvent CS-1 was replaced with compound I-14.

Dispersion 3-4 was prepared similarly to Dispersion 3-1, except that half of the solvent CS-1 was replaced with compound I-25.

Dispersion 3-5 was prepared similarly to Dispersion 3-1, except that half of the solvent CS-1 was replaced with compound I-26.

Dispersion 3-6 was prepared similarly to Dispersion 3-1, except that half of the solvent CS-1 was replaced with compound I-1.

Each of these coupler dispersions was coated in a coating structure similar to that employed in Example 1, as modified by the dispersions employed, with individual coupler, solvent and stabilizer coverages in the photosensitive layer for each coating being either reported in Table 5 or defined by the dispersion identity. The photosensitive layer for Coating 301 additionally comprised 0.0095 $g/m^2$ HQ-K (2,5-dihydroxy-4-(1-methylheptadecyl)-benzenesulphonic acid (K salt)). Sample strips of the coatings were exposed, processed, and evaluated as in Example 1, and results are reproduced in Table 5.

TABLE 5

Photographic Responses for Coatings 301–307.

| Ctg | Disp | Solvent | Solvent $g/m^2$ | P-1 $g/m^2$ | Shldr | Dma X | HID3 W10 | HID5 W10 | ABS-500 | |
|---|---|---|---|---|---|---|---|---|---|---|
| 301 | 3-1 | CS-1 | 0.218 | 0.484 | 1.89 | 2.18 | −0.246 | −0.492 | 0.524 | Comparison |
| 302 | 3-1 | CS-1 | 0.218 | 0 | 1.89 | 2.18 | −0.292 | −0.693 | 0.536 | Comparison |
| 303 | 3-2 | CS-1/ I-2 | 0.109/ 0.109 | 0 | 1.88 | 2.15 | −0.228 | −0.548 | 0.526 | Invention |

TABLE 5-continued

Photographic Responses for Coatings 301–307.

| Ctg | Disp | Solvent | Solvent g/m$^2$ | P-1 g/m$^2$ | Shldr | Dma X | HID3 W10 | HID5 W10 | ABS-500 | |
|---|---|---|---|---|---|---|---|---|---|---|
| 304 | 3-3 | CS-1/ 1-14 | 0.109/ 0.109 | 0 | 1.85 | 2.13 | −0.254 | −0.592 | 0.526 | Invention |
| 305 | 3-4 | CS-1/ I-25 | 0.109/ 0.109 | 0 | 1.86 | 2.12 | −0.311 | −0.691 | 0.529 | Invention |
| 306 | 3-5 | CS-1/ I-26 | 0.109/ 0.109 | 0 | 1.83 | 2.10 | −0.307 | −0.682 | 0.533 | Invention |
| 307 | 3-6 | CS-1/ I-11 | 0.109/ 0.109 | 0 | 1.87 | 2.14 | −0.277 | −0.628 | 0.53 | Invention |

The removal of latex P-1 and HQ-K from 301 results in less light stability, as shown by comparison on 302 to 301. Replacement of 50% of solvent CS-1 with compounds I-2, I-14, I-11, I-26 in accordance with the invention result in improved light stability vs. 302, while I-25 improves the hue of the dye.

Example 4

Dispersion 4-1 was prepared by dissolving 135.3 g of coupler YC2 and 39.5 g of stabilizer YSt-4 in 71.2 g of solvent CS-1 at 110° C. An aqueous gelatin solution of 150.0 g gelatin, 960.3 g water, 14.7 g propionic acid (2N), and 129.0 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by once passing it through a Crepaco homogenizer at 5000 psi.

Dispersion 4-2 was prepared by dissolving 63.1 g of coupler YC2, 9.2 g of stabilizer YSt-9, and 18.4 g of stabilizer YSt-4 in 33.2 g of solvent CS-1 at 110° c. An aqueous gelatin solution of 70.0 g gelatin, 438.9 g water, 6.9 g propionic acid (2N), and 60.2 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 75° C.

Dispersions 4-3 through 4-11 were prepared similarly to Dispersion 4-2, except substituting stabilizers and solvents as indicated in Table 6 below.

TABLE 6

Dispersions 4-1 through 4-11.

| Disp | YC-2 | YSt-4 | YSt-9 | YSt-1 | Solvent | Gel | Water | 2N propionic acid | 10% Alkanol XC | Total |
|---|---|---|---|---|---|---|---|---|---|---|
| 4-1 | 135.3 | 39.5 | 0.0 | 0.0 | 71.2 (CS-1) | 150.0 | 960.3 | 14.7 | 129.0 | 1500.0 |
| 4-2 | 63.1 | 18.4 | 9.2 | 0.0 | 33.2 (CS-1) | 70.0 | 438.9 | 6.9 | 60.2 | 700.0 |
| 4-3 | 63.1 | 0.0 | 9.2 | 18.4 | 33.2 (CS-1) | 70.0 | 438.9 | 6.9 | 60.2 | 700.0 |
| 4-4 | 31.6 | 9.2 | 4.6 | 0.0 | 16.6 (I-2) | 35.0 | 219.5 | 3.4 | 30.1 | 350.0 |
| 4-5 | 31.6 | 9.2 | 4.6 | 0.0 | 16.6 (I-3) | 35.0 | 219.5 | 3.4 | 30.1 | 350.0 |
| 4-6 | 31.6 | 9.2 | 4.6 | 0.0 | 16.6 (I-4) | 35.0 | 219.5 | 3.4 | 30.1 | 350.0 |
| 4-7 | 31.6 | 9.2 | 4.6 | 0.0 | 16.6 (I-5) | 35.0 | 219.5 | 3.4 | 30.1 | 350.0 |
| 4-8 | 31.6 | 0.0 | 4.6 | 9.2 | 16.6 (I-5) | 35.0 | 219.5 | 3.4 | 30.1 | 350.0 |
| 4-9 | 28.5 | 8.3 | 4.2 | 0.0 | 29.9 (I-5) | 40.0 | 250.8 | 3.9 | 34.4 | 400.0 |
| 4-10 | 28.1 | 8.2 | 4.1 | 0.0 | 44.4 (I-5) | 40.0 | 236.9 | 3.9 | 34.4 | 400.0 |
| 4-11 | 28.1 | 8.2 | 4.1 | 0.0 | 14.8 (CS-1) 29.6 (I-5) | 40.0 | 236.9 | 3.9 | 34.4 | 400.0 |

Each of these dispersions was combined with a blue-sensitive chloro-iodide emulsion and coated as the first layer of a three-color photographic recording material on a resin-coated paper support. The subsequent layers were identical for all the coatings and consisted, in order, of a layer containing a scavenger for oxidized developer, a green imaging layer, a second scavenger layer, a red imaging layer, a UV absorbing layer and a protective gelatin super-coat. Details of the structure of the multilayer coating, including component coverages in each layer, are shown below.

| Coating structure | |
|---|---|
| Layer 7 (Supercoat) | |
| Ludox AM ® (DuPont) | 0.172 g.m$^{-2}$ |
| Gel | 0.861 g.m$^{-2}$ |
| Coating Surfactant | |
| Layer 6 (UV layer) | |
| Tinuvin-328 ® | 0.426 g.m$^{-2}$ |
| Tinuvin 326 ® | 0.023 g.m$^{-2}$ |
| DMBHQ | 0.042 g.m$^{-2}$ |
| CS-6 | 0.051 g.m$^{-2}$ |
| Gel | 0.515 g.m$^{-2}$ |
| Layer 5 (Red-sensitive Layer) | |
| Ag Halide emulsion | 0.240 g.m$^{-2}$ (as Ag) |
| Coupler CC-1 | 0.279 g.m$^{-2}$ |

-continued

| Coating structure | |
|---|---|
| Coupler CC-2 | 0.031 $g.m^{-2}$ |
| Tinuvin 328 ® | 0.271 $g.m^{-2}$ |
| CS-6 | 0.174 $g.m^{-2}$ |
| CS-7 | 0.523 $g.m^{-2}$ |
| Gel | 1.563 $g.m^{-2}$ |
| Layer 4 (Interlayer B) | |
| DMBHQ | 0.1076 $g.m^{-2}$ |
| CS-2 | 0.1968 $g.m^{-2}$ |
| Gel | 0.7532 $g.m^{-2}$ |
| Layer 3 (Green-sensitive Layer) | |
| Ag Halide emulsion | 0.142 $g.m^{-2}$ (as Ag) |
| Coupler MC-1 | 0.208 $g.m^{-2}$ |
| YSt-9 | 0.040 $g.m^{-2}$ |
| YSt-8 | 0.274 $g.m^{-2}$ |
| CS-8 | 0.218 $g.m^{-2}$ |
| CS-2 | 0.112 $g.m^{-2}$ |
| Gel | 1.310 $g.m^{-2}$ |
| Layer 2 (Interlayer A) | |
| DMBHQ | 0.1076 $g.m^{-2}$ |
| CS-2 | 0.1968 $g.m^{-2}$ |
| Gel | 0.7532 $g.m^{-2}$ |
| Layer 1 (Blue-sensitive Layer) | |
| Ag Halide emulsion | 0.238 $g.m^{-2}$ (as Ag) |
| Coupler YC2 | 0.414 $g.m^{-2}$ |

-continued

| Coating structure | |
|---|---|
| Stabilizers YSt-1, YST-4, YSt-9 | as specified by Table 7 below |
| Solvents | as specified by Table 7 below |
| HQ-K | 0.0095 $g.m^{-2}$ |
| PHR | 0.0024 $g.m^{-2}$ |
| Latex copolymer P-1 | as specified by Table 7 below |
| Gel | 1.31 $g.m^{-2}$ |
| Hardener | 0.138 $g.m^{-2}$ |

Support
PHR = 2,5-dihydroxy-5-methyl-3-(1-piperidenyl)-2-cyclopenten-1-one
HQ-K = 2,5-dihydroxy-4-(1-methylheptadecyl)-benzenesulphonic acid (K salt)
Latex copolymer = 50/50 t-butylacrylamide/t-butylacrylate latex copolymer
DMBHQ = 2,5-di-(1,1,3,3-tetramethylbutyl)hydroquinone
Hardener = bis(vinylsulphonyl)methane In the coating structure, the green imaging layer was comprised of a dispersion of magenta coupler MC-1 mixed with a green-sensitive iodo-chloride emulsion while a similar red-sensitized chloride emulsion was mixed with a dispersion of cyan couplers CC-1 and CC-2 to form the red imaging layer. The coupler dispersions were prepared similarly to dispersion 1-1.

The structures of the couplers MC-1 and CC-1 and CC-2 are shown below.

MC-1

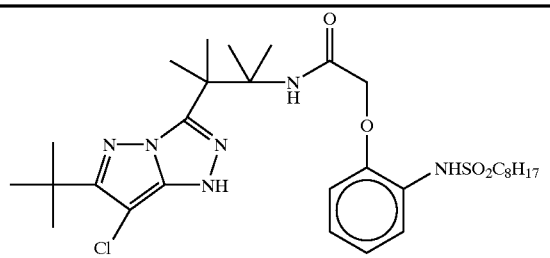

CC-1

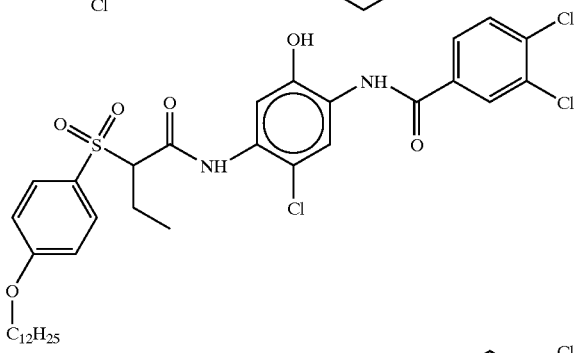

CC-2

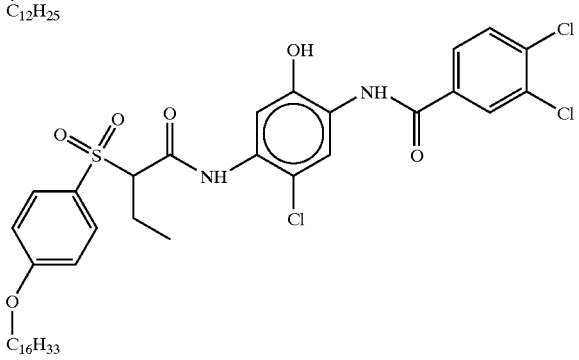

Sample strips of the coatings were exposed to blue light (Wratten 98 filter) through a step tablet (density range 0–3, 0.15 increments) and developed in standard Kodak RA4 processing solutions before washing and drying. Sensitometry and light stability of the resultant yellow image were measured as described in Example 1. Results are reported in Table 7.

Thermal Induced Change

An apparatus was constructed to assess thermal induced changes to the formed image dyes (covering power) of the processed samples. The apparatus consisted of a uniform heated sample platen jaw assembly which provided user definable temperatures from ambient to 350 F. A sample release sleeve pouch was fabricated by folding a piece of a commercially available release sheet (used for hot mounting of photographic prints) in half. This pouch was used to both insert the sample into the heated platen as well as allow for good release of the test sample by ensuring that the gelatin contained in the sample would not fuse to the platen. The platen jaw assembly also comprised a method to ensure uniform pressure on the sample with a user definable range from 10 to 60 psi, as well as user definable dwell times (defined as contact time in the platen jaws) from 1 to 999 seconds.

Separation (RGB) step tablet exposures were placed on samples using contact optical printing of a fabricated pieced carbon step target containing RGB separation filters and said samples were processed by conventional color paper processing methods. The resulting step tablets were then densitometered using conventional 45/0 Status A reflection densitometry.

Each sample was then inserted into the release sleeve pouch and placed into the test apparatus. After the specified sample treatment (60 psi, 200 F., 60 seconds dwell time) each sample was re-read with Status A densitometry. Differences in sensitometric response were determined and attributed to the thermal action (covering power change) on the formed image dye structure. The thermal induced change in blue density from a starting value of 1.0 is reported in Table 7 (TIC@1.0).

Pressure Fog Test

An apparatus was constructed to assess the propensity for emulsion fogging caused by applying pressure to unexposed samples of the photographic element coatings. The apparatus consisted of a specifically designed patterned roller (embossing roller) and smooth drive roller with a 5000 psi load in which the sensitized samples for coating 401–405 and 407–410 were embossed emulsion side towards the patterned roller in total dark. The pattern was specific as to result in irreversible indentations in the emulsion side of the photographic element in a manner such that both compressive and torsion forces would be applied The samples were then processed (without any exposure to visible light or other intentional radiation source) by conventional RA-4 color developer chemistry and development times. The processed embossed minimum density strips were then assessed for any coloration formed by the embossing (coloration caused by the torsion and or compressive forces of the embossing roller and subsequent latent image formation on the sensitized silver grains) through total collection geometry spectrophotometry for the visible wavelengths from 420 nm to 720 nm. Data output was presented as both Percent Spectral Reflection as a function of wavelength as well as 1976 CIE Lab D65 illuminant units. Magnitude of coloration (b*) was used to assess impact of these torsion and compressive forces on the photographic element. Typically the direction of coloration when observed was found to be yellow (+b*). The more negative or lower b* numbers indicates a less sensitive emulsion layer, which is preferred as it indicates an emulsion system that is more resistant to these torsion and compressive effects that could be found in the manufacturing process (such as slitting operations). b* values are reported in Table 7.

TABLE 7

Photographic Results of Coatings 401–413 (units in g/m2)

| Ctg | Disp | Solvent | YSt-4 | YSt-1 | YSt-9 | P-1 | Shldr | Dmax | HID3 W10 | HID5 W10 | TIC@ 1.0 | b* |
|---|---|---|---|---|---|---|---|---|---|---|---|---|
| 401 (Comp) | 4-1 | 0.218 (CS-1) | 0.121 | | | 0.484 | 1.83 | 2.07 | −0.21 | −0.41 | 0.079 | 0.92 |
| 402 (Comp) | 4-2 | 0.218 (CS-1) | 0.121 | | 0.060 | 0.355 | 1.86 | 2.11 | −0.16 | −0.33 | 0.075 | 0.76 |
| 403 (Comp) | 4-2 | 0.218 (CS-1) | 0.121 | | 0.060 | 0 | 1.83 | 2.06 | −0.27 | −0.66 | 0.034 | 2.01 |
| 404 (Comp) | 4-3 | 0.218 (CS-1) | | 0.121 | 0.060 | 0.355 | 1.86 | 2.1 | −0.14 | −0.29 | 0.084 | 1.03 |
| 405 (Comp) | 4-3 | 0.218 (CS-1) | | 0.121 | 0.060 | 0 | 1.85 | 2.09 | −0.21 | −0.55 | 0.028 | 1.84 |
| 406 (Inv) | 4-4 | 0.218 (I-2) | 0.121 | | 0.060 | 0 | 1.78 | 2.02 | −0.22 | −0.44 | 0.039 | — |
| 407 (Inv) | 4-5 | 0.218 (I-3) | 0.121 | | 0.060 | 0 | 1.8 | 2.05 | −0.22 | −0.44 | 0.037 | 1.83 |
| 408 (Inv) | 4-6 | 0.218 (I-4) | 0.121 | | 0.060 | 0 | 1.77 | 2.02 | −0.23 | −0.47 | 0.038 | 1.77 |
| 409 (Inv) | 4-7 | 0.218 (I-5) | 0.121 | | 0.060 | 0 | 1.79 | 2.04 | −0.23 | −0.47 | 0.04 | 1.18 |
| 410 (Inv) | 4-8 | 0.218 (I-5) | | 0.121 | 0.060 | 0 | 1.8 | 2.04 | −0.19 | −0.42 | 0.032 | 1.21 |
| 411 (Inv) | 4-9 | 0.437 (I-5) | 0.121 | | 0.060 | 0 | 1.81 | 2.06 | −0.18 | −0.38 | 0.044 | — |

TABLE 7-continued

Photographic Results of Coatings 401–413 (units in g/m2)

| Ctg | Disp | Solvent | YSt-4 | YSt-1 | YSt-9 | P-1 | Shldr | Dmax | HID3 W10 | HID5 W10 | TIC@ 1.0 | b* |
|---|---|---|---|---|---|---|---|---|---|---|---|---|
| 412 (Inv) | 4-10 | 0.656 (I-5) | 0.121 | | 0.060 | 0 | 1.81 | 2.06 | −0.17 | −0.34 | 0.055 | — |
| 413 (Inv) | 4-11 | 0.218 (CS-1)/ 0.437 (I-5) | 0.121 | | 0.060 | 0 | 1.85 | 2.07 | −0.17 | −0.38 | 0.045 | — |

The inclusion of YSt-9 in coating 402 enables a reduction in the amount of latex P-1 used in 401, with an improvement in light stability. However, as shown by the light fade of 403, this amount of YSt-9 is insufficient to enable the complete removal of latex P-1. Changing stabilizer YSt-4 for YSt-1 offers further improvement in light stability, but there this too is not enough to enable complete removal of latex P-1, as shown by coatings 404 and 405. Coatings 406, 407 shows that the replacement of CS-1 in 403 with compounds I-2 and I-3, respectively, gives an improvement in light stability. The light stability of 406 and 407, without latex P-1, are almost equal to coating 401. Use of I-4 or I-5 in coatings 408 and 409 also give improvements in light stability over 403. Using YSt-1 instead of YSt-4 gives an improvement which enables 410 to have nearly the same light stability of 401. Increasing the amount of I-5 with stabilizer YSt-4 further improves the light stability, exceeding that of coating 401. When using I-5 in place of CS-1, as in 409 vs 403, the shoulder and Dmax decrease. Coating 413 demonstrates that the activity can be maintained while still maintaining the light stability improvement obtained by the use of the compound of Formula I and without the use of latex P-1. Pressure fog as measured by b* is better when using the compounds of Formula I in the absence of latex P-1 than when using solvent CS-1. The TIC (density increase from thermal treatment) of coatings with the compounds of Formula I is much less than when using latex P-1 for light stability.

Example 5

Dispersion 5-1 was prepared by dissolving 63.1 g of coupler YC2 and 18.4 g of stabilizer YSt-4 in 33.2 g of solvent CS-1 at 110° C. An aqueous gelatin solution of 70.0 g gelatin, 448.1 g water, 6.9 g propionic acid (2N), and 60.2 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 75° C.

Dispersions 5-2 through 5-14 were made similarly to Dispersion 5-1, except substituting stabilizers and solvents as indicated in Table 8 below.

TABLE 8

Dispersions 5-1 through 5-14.

| Disp | YC-2 | YSt-1 | YSt-5 | YSt-4 | YSt-9 | CS-1 | I-2 | Gel | Water | Propionic Acid (2N) | Alkanol XC (10%) | Total |
|---|---|---|---|---|---|---|---|---|---|---|---|---|
| 5-1 | 63.1 | 0.0 | 0.0 | 18.4 | 0.0 | 33.2 | 0.0 | 70.0 | 448.1 | 6.9 | 60.2 | 700 |
| 5-2 | 60.3 | 0.0 | 0.0 | 17.6 | 0.0 | 31.7 | 70.5 | 85.0 | 503.4 | 8.3 | 73.1 | 850 |
| 5-3 | 39.0 | 8.6 | 2.9 | 0.0 | 0.0 | 20.5 | 45.6 | 55.0 | 325.7 | 5.4 | 47.3 | 550 |
| 5-4 | 49.6 | 10.9 | 3.6 | 0.0 | 0.0 | 26.1 | 0.0 | 55.0 | 352.1 | 5.4 | 47.3 | 550 |
| 5-5 | 99.2 | 21.7 | 7.3 | 0.0 | 14.5 | 52.2 | 0.0 | 110.0 | 689.7 | 10.8 | 94.6 | 1100 |
| 5-6 | 62.0 | 13.6 | 4.5 | 0.0 | 9.1 | 32.6 | 26.6 | 70.0 | 414.5 | 6.9 | 60.2 | 700 |
| 5-7 | 60.3 | 13.2 | 4.4 | 0.0 | 8.8 | 31.7 | 61.7 | 85.0 | 503.4 | 8.3 | 73.1 | 850 |
| 5-8 | 39.1 | 0.0 | 0.0 | 11.4 | 5.7 | 20.5 | 39.9 | 55.0 | 325.7 | 5.4 | 47.3 | 550 |
| 5-9 | 66.2 | 23.7 | 7.9 | 0.0 | 15.8 | 34.8 | 0.0 | 70.0 | 414.5 | 6.9 | 60.2 | 700 |
| 5-10 | 43.7 | 15.6 | 5.2 | 0.0 | 10.4 | 23.0 | 18.7 | 55.0 | 325.7 | 5.4 | 47.3 | 550 |
| 5-11 | 60.4 | 21.6 | 7.2 | 0.0 | 14.4 | 31.7 | 45.0 | 85.0 | 503.4 | 8.3 | 73.1 | 850 |
| 5-12 | 35.7 | 12.8 | 4.3 | 0.0 | 8.5 | 18.8 | 36.5 | 44.0 | 336.7 | 5.4 | 47.3 | 550 |
| 5-13 | 34.0 | 0.0 | 0.0 | 19.9 | 5.0 | 17.9 | 39.8 | 44.0 | 336.7 | 5.4 | 47.3 | 550 |
| 5-14 | 34.0 | 9.9 | 0.0 | 9.9 | 5.0 | 17.9 | 39.8 | 44.0 | 336.7 | 5.4 | 47.3 | 550 |

Each of these dispersions was combined with a blue-sensitive chloro-iodide emulsion and coated as the first layer of a three-color photographic recording material on a resin-coated paper support similarly as described for Example 4 above, except the supercoat (Layer 7) comprised 0.241 g/m$^2$ Ludox AM® (DuPont) and 0.565 g/m$^2$ gelatin, and the Blue-sensitive layer (Layer 1) comprised 0.095 g/m$^2$ HQ-K for coating 501 and 0.0095 g/m$^2$ HQ-K for coatings 502-516.

Sample strips of the coatings were exposed to blue light (Wratten 98 filter) through a step tablet (density range 0–3, 0.15 increments) and developed in standard Kodak RA4 processing solutions before washing and drying. Sensitometry, light stability, pressure fog and TIC of the resultant yellow image were measured as described in Examples 1 and 4. Results are reported in Table 9.

TABLE 9

Photographic Results for Coatings 501 through 516. (units in g/m2)

| Ctg | Disp | CS-1 | I-2 | YSt-1 | YSt-5 | YSt-4 | YSt-9 | P-1 | Shldr | Dmax | HID3 W10 | HID5 W10 | TIC @1.0 | b* |
|---|---|---|---|---|---|---|---|---|---|---|---|---|---|---|
| 501 | 5-1 | 0.218 | | 0.00 | 0.00 | 0.121 | 0.00 | 0.484 | 1.94 | 2.3 | −0.239 | −0.474 | 0.064 | −1.05 |
| 502 | 5-1 | 0.218 | | 0.00 | 0.00 | 0.121 | 0.00 | 0.484 | 1.97 | 2.33 | −0.196 | −0.398 | 0.051 | −0.27 |
| 503 | 5-2 | 0.218 | 0.484 | 0.00 | 0.00 | 0.121 | 0.00 | | 1.94 | 2.29 | −0.194 | −0.459 | 0.035 | −0.88 |
| 504 | 5-3 | 0.218 | 0.484 | 0.091 | 0.030 | 0.00 | 0.00 | | 1.96 | 2.31 | −0.267 | −0.668 | 0.038 | −0.88 |
| 505 | 5-4 | 0.218 | | 0.091 | 0.030 | 0.00 | 0.00 | 0.484 | 1.98 | 2.33 | −0.248 | −0.542 | 0.059 | 0.15 |
| 506 | 5-5 | 0.218 | | 0.091 | 0.030 | 0.00 | 0.060 | 0.178 | 1.99 | 2.32 | −0.162 | −0.413 | 0.025 | 0.05 |
| 507 | 5-5 | 0.218 | 0 | 0.091 | 0.030 | 0.00 | 0.060 | | 1.97 | 2.31 | −0.204 | −0.575 | 0.023 | 0.31 |
| 508 | 5-6 | 0.218 | 0.178 | 0.091 | 0.030 | 0.00 | 0.060 | | 1.98 | 2.32 | −0.156 | −0.379 | 0.028 | −0.42 |
| 509 | 5-7 | 0.218 | 0.423 | 0.091 | 0.030 | 0.00 | 0.060 | | 1.97 | 2.31 | −0.147 | −0.329 | 0.032 | −0.88 |
| 510 | 5-8 | 0.218 | 0.423 | 0.00 | 0.00 | 0.121 | 0.060 | | 1.96 | 2.31 | −0.151 | −0.325 | 0.032 | 0.03 |
| 511 | 5-9 | 0.218 | 0 | 0.148 | 0.049 | 0.00 | 0.099 | | 1.96 | 2.31 | −0.150 | −0.335 | 0.023 | −0.57 |
| 512 | 5-10 | 0.218 | 0.178 | 0.148 | 0.049 | 0.00 | 0.099 | | 1.95 | 2.31 | −0.132 | −0.280 | 0.031 | −0.88 |
| 513 | 5-11 | 0.218 | 0.309 | 0.148 | 0.049 | 0.00 | 0.099 | | 1.97 | 2.32 | −0.121 | −0.255 | 0.039 | −0.98 |
| 514 | 5-12 | 0.218 | 0.423 | 0.148 | 0.049 | 0.00 | 0.099 | | 1.96 | 2.33 | −0.123 | −0.255 | 0.047 | −0.07 |
| 515 | 5-13 | 0.218 | 0.484 | 0.00 | 0.00 | 0.242 | 0.060 | | 1.94 | 2.31 | −0.128 | −0.263 | 0.042 | −1.13 |
| 516 | 5-14 | 0.218 | 0.484 | 0.121 | 0.00 | 0.121 | 0.060 | | 1.94 | 2.31 | −0.128 | −0.264 | 0.046 | −0.49 |

Reduction of HQ-K by a factor of 10 in amount, plus replacement of latex P-1 with compound I-2 enables coating 403 to match the light stability of coating 401 with improved thermal induced change (TIC) and pressure fog. Replacement of YSt-4 with YSt-1/YSt-5 reduces the light stability, as shown by comparison of 504, 505 to 502, 503. Addition of YSt-9 improves the light stability enough when using YSt-1/YSt-5 to enable reduction in the amount of latex P-1, but not enough to completely eliminate P-1, as shown by comparison of 505, 506, 507 to 501, 502. In coating 508, the use of compound I-2 in place of latex P-1 in coating 506 enables complete elimination of latex P-1, improved light stability and lower pressure fog at comparable TIC. Increasing the level of I-2 from that used in 508 to that of 509 further improves the light stability and pressure fog, with very little increase in TIC. Increasing the levels of YSt-1/YSt-5/YSt-9 as in coating 511 give further improvement in light stability vs 507, but the addition of increasing levels of I-2 gives further improvement to the light stability, as in 512, 513, and 514. In all cases where the compound of Formula I is employed, the use of CS-1 as a co-solvent enables very little change in shoulder and especially Dmax. Surprisingly, when using compounds of Formula I in accordance with the invention in combination with YSt-9, replacement of YSt-4 in 510 with YSt-1/YSt-5 in 509 does not show a decrease in light stability as might be expected from comparison of coatings 504 to 503 and 505 to 502. Coatings 515 and 516 indicate a similar trend.

Example 6

Dispersion 6-1 was prepared by dissolving 2.00 g of coupler YC-18, 0.18 g of stabilizer YSt-1, 0.06 g of stabilizer YSt-5, and 0.24 g of stabilizer YSt-9 in 1.00 g of solvent CS-1 at 130° C. An aqueous gelatin solution of 3.75 g of gelatin, 64.00 g water, and 3.75 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 80° C.

Dispersions 6-2 and 6-3 were prepared similarly to dispersion 6-1, except that the solvent CS-1 was either partially or completely replaced with I-2, as according to Table 10 below. The amounts of the other components in the oil phase were unaltered, and water was adjusted to maintain a total dispersion amount of 75.0 g.

TABLE 10

Dispersion 6-1 through 6-3

| Dispersion | Solvent(s) | Amount(s) | |
|---|---|---|---|
| 6-1 | CS-1 | 1.0 g | Comparison |
| 6-2 | I-2 | 1.0 g | Invention |
| 6-3 | CS-1/I-2 | 0.5 g/0.5 g | Invention |

Each of these coupler dispersions was diluted with further aqueous gelatin and mixed with a blue-sensitive cubic silver iodo-chloride photographic emulsion (average edge length: 0.76 $\mu$m) for coating on a resin-coated paper support, pre-coated with an unhardened gel pad. The mixing of the already molten components was carried out immediately prior to coating. The full coating structure is shown below.

Coating Structure

| | |
|---|---|
| GEL SUPERCOAT | |
| Gelatin | 1.077 $g.m^{-2}$ |
| Hardener* | 0.176 $g.m^{-2}$ |
| Coating surfactants | |
| UV LAYER | |
| Gelatin | 1.399 $g.m^{-2}$ |
| Tinuvin-328 ® | 0.510 $g.m^{-2}$ |
| Tinuvin-326 ® | 0.090 $g.m^{-2}$ |
| Dioctyl hydroquinone | 0.193 $g.m^{-2}$ |
| CS-6 | 0.235 $g.m^{-2}$ |
| PHOTOSENSITIVE LAYER | |
| Gelatin | 2.15 $g.m^{-2}$ |
| Coupler YC-18 | 0.429 $g.m^{-2}$ |
| YSt-1 | 0.039 $g.m^{-2}$ |
| YSt-5 | 0.013 $g.m^{-2}$ |
| YSt-9 | 0.051 $g.m^{-2}$ |
| Solvent(s) | as specified by Table 11 below |
| PHR | 0.0023 $g.m^{-2}$ |
| Ag | 0.199 $g.m^{-2}$ |
| GEL PAD | |
| Gelatin | 3.230 $g.m^{-2}$ |
| Resin Coated Paper | |

*Hardener = bis(vinylsulphonylmethane)

Sample strips of the coatings were expose, processed and evaluated as in Example 1, except fade evaluation was performed after 4 weeks of 50 Klux exposure. Results are reported in Table 11.

TABLE 11

Photographic Results on Coatings 601 through 603

| ctg | Disp | Solvent | Solvent Laydown ($g.m^{-2}$) | Shoulder | Dmax | 4W 50 Klux @ 1.0 | |
|---|---|---|---|---|---|---|---|
| 601 | 6-1 | CS-1 | 0.215 | 1.81 | 2.15 | −0.39 | Comparison |
| 602 | 6-2 | I-2 | 0.215 | 1.69 | 1.96 | −0.18 | Invention |
| 603 | 6-3 | I-2/ CS-1 | 0.108/ 0.108 | 1.77 | 2.09 | −0.22 | Invention |

Compared to Coating 601, coating 602 with compound I-2 shows markedly improved light stability, but with reduced dispersion reactivity. In example 603, comparison solvent CS-1 is blended with compound I-2; dispersion reactivity is much greater than in coating 602 and light stability is still markedly better than comparison coating 601.

Example 7

Dispersion 7-1 was prepared by dissolving 2.00 g of coupler YC-18, 0.43 g of stabilizer YSt-1, 0.14 g of stabilizer YSt-5, and 0.58 g of stabilizer YSt-9 in 1.26 g of solvent CS-1 at 130° C. An aqueous gelatin solution of 3.75 g of gelatin, 63.00 g water, and 3.75 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 80° C.

Dispersions 7-2 and 7-3 were similarly prepared except that the solvent CS-1 was either partially or completely replaced with I-3, as according to Table 12 below. The amounts of the other components in the oil phase were unaltered, and water was adjusted to maintain a total dispersion amount of 75.0 g.

TABLE 12

Dispersions 7-1 through 7-3

| Dispersion | Solvent(s) | Amount(s) | |
|---|---|---|---|
| 7-1 | CS-1 | 1.26 g | Comparison |
| 7-2 | I-3 | 1.26 g | Invention |
| 7-3 | CS-1/I-3 | 0.63 g/0.63 g | Invention |

Coatings were prepared similarly as described in example 6, with the photosensitive layer composition as shown below.

| PHOTOSENSITIVE LAYER | |
|---|---|
| Gelatin | 2.15 $g.m^{-2}$ |
| Coupler YC-18 | 0.429 $g.m^{-2}$ |
| YSt-1 | 0.092 $g.m^{-2}$ |
| YSt-5 | 0.030 $g.m^{-2}$ |
| YSt-9 | 0.124 $g.m^{-2}$ |
| Coupler solvent | as specified by Table 13 below |

-continued

| PHOTOSENSITIVE LAYER | |
|---|---|
| PHR | 0.0024 $g.m^{-2}$ |
| Ag | 0.215 $g.m^{-2}$ |

Sample strips of the coatings were expose, processed and evaluated as in Example 6. Results are reported in Table 11.

TABLE 13

Photographic Results on Coatings 701 through 703

| Ctg | Disp | Solvent | Solvent Laydown ($g.m^{-2}$) | Shoulder | Dmax | 4W 50 Klux @ 1.0 | |
|---|---|---|---|---|---|---|---|
| 701 | 7-1 | CS-1 | 0.270 | 2.00 | 2.25 | −0.20 | Comparison |
| 702 | 7-2 | I-3 | 0.270 | 1.78 | 1.96 | −0.12 | Invention |
| 703 | 7-3 | I-3/ CS-1 | 0.135/ 0.135 | 1.92 | 2.17 | −0.13 | Invention |

Compared to Coating 701 which shows good light stability due to the high level of stabilizers contained in the dispersion, coating 702 with compound I-3 shows much better light stability, but with reduced dispersion reactivity. In example 703, comparison solvent CS-1 is blended with compound I-3; dispersion reactivity is much greater than in coating 702 and almost all of the light stability advantage shown by coating 701 is preserved.

Example 8

Dispersion 8-1 was prepared by dissolving 26.3 g of coupler YC-2, 7.3 g of stabilizer YSt-1, 1.0 g of YSt-5, 5.2 g YSt-4 in 12.9 g of solvent CS-1 and 10.3 g I-2 at 110° C. An aqueous gelatin solution of 30.0 g gelatin, 178.3 g water, 2.9 g propionic acid (2N), and 25.7 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 75° C.

Dispersions 8-2 and 8-3 were prepared as Dispersion 8-1, except that the amounts of the oil phase components were as stated in Table 14 below.

Dispersions 8-4 and 8-5 were prepared as Dispersion 8-1, except that I-2 was replaced with I-16 and I-13, respectively.

TABLE 14

Dispersions 8-1 to 8-5

| Dispersion | YC-2 | YSt-1 | YSt-5 | YSt-9 | Solvents |
|---|---|---|---|---|---|
| 8-1 | 26.3 | 7.3 | 1.0 | 5.2 | 12.9 (CS-1) + 10.3 (I-2) |
| 8-2 | 29.9 | 8.4 | 1.2 | 5.9 | 14.7 (CS-1) + 2.9 (I-2) |
| 8-3 | 23.4 | 6.5 | 0.9 | 4.6 | 11.5 (CS-1) + 16.1 (I-2) |
| 8-4 | 26.3 | 7.3 | 1.0 | 5.2 | 12.9 (CS-1) + 10.3 (I-16) |
| 8-5 | 26.3 | 7.3 | 1.0 | 5.2 | 12.9 (CS-1) + 10.3 (I-13) |

Coating were prepared similarly as described in Example 6, with the photosensitive layer composition shown below.

| PHOTOSENSITIVE LAYER | |
|---|---|
| Gelatin | 1.402 $g.m^{-2}$ |
| Coupler YC2 | 0.439 $g.m^{-2}$ |
| YSt-1 | 0.140 $g.m^{-2}$ |
| YSt-9 | 0.086 $g.m^{-2}$ |
| Coupler solvent | As specified by Table 15 below |
| PHR | 0.0024 $g.m^{-2}$ |
| Ag | 0.210 $g.m^{-2}$ |

Sample strips of the coatings were exposed and processed as described in the previous examples, and the results are reported in Table 15.

TABLE 15

Photographic Results on Coatings 801 through 805

| Ctg | Disp | CS-1 | Compound of Formula I | Compound of Formula I Laydown | Shldr | Dmax | HID3W10 | HID5W10 | ABS500 |
|---|---|---|---|---|---|---|---|---|---|
| 801 | 8-1 | 0.215 | I-2 | 0.172 | 1.886 | 2.288 | −0.153 | −0.392 | 0.533 |
| 802 | 8-2 | 0.215 | I-2 | 0.043 | 1.885 | 2.274 | −0.17 | −0.453 | 0.533 |
| 803 | 8-3 | 0.215 | I-2 | 0.301 | 1.884 | 2.274 | −0.144 | −0.341 | 0.514 |
| 804 | 8-4 | 0.215 | I-16 | 0.172 | 1.906 | 2.281 | −0.147 | −0.363 | 0.52 |
| 805 | 8-5 | 0.215 | I-13 | 0.172 | 1.895 | 2.286 | −0.135 | −0.32 | 0.527 |

Comparison of coatings 804 and 805 with coating 801 shows that similar if not better image stability can be achieved with compounds I-16 and I-13 as with 1-2. Coatings 802 and 803 show that the image stability can be adjusted by varying the amount of the compound of Formula I coated with the yellow coupler.

Example 9

Dispersion 9-1 was prepared by dissolving 102.7 g of coupler YC2, 42.8 g of stabilizer YSt-1, 6.1 g of stabilizer YSt-5 and 24.4 g stabilizer YSt-9 in 54.0 g of solvent CS-1 at 110° C. An aqueous gelatin solution of 85.0 g gelatin, 555.2 g water, 9.8 g propionic acid (2N), and 120.0 g of a 10% aqueous solution of surfactant Alkanol XC was prepared at 80° C. The hot oil phase was mixed with the aqueous gelatin solution for 2 minutes at 8000 rpm using a Brinkmann rotor-stator mixer. This mixture was then homogenized by twice passing it through a Microfluidics Microfluidizer at 8000 psi, at a temperature of 75° C.

Dispersion 9-2 was made similarly to Dispersion 9-1, except that the amounts of each oil phase component were as follows: 77.0 g of coupler YC2, 32.1 g of stabilizer YSt-1, 4.6 g of stabilizer YSt-5, and 18.3 g stabilizer YSt-9 in 97.9 g of solvent CS-1 at 110° C.

Dispersion 9-3 was made similarly to Dispersion 9-2, except replacing 58.6% of solvent CS-1 with compound I-2 as specified in the table below, so that the ratio of CS-1 to coupler YC-2 was the same as in Dispersion 9-1.

Dispersions 9-4 through 9-16 were made similarly to Dispersion 9-3, except replacing compound I-2 as specified in the table below. Occasionally a solvent would require additional heating until the temperature was sufficient to completely dissolve it. The oil phase temperature required is reported in Table 16 below.

Dispersion 9-17 was prepared similarly to Dispersion 9-1, except that amounts of the components were as follows: 122.0 g of coupler YC2, 31.5 g of stabilizer YSt-1, 5.1 g of stabilizer YSt-5, and 34.8 g stabilizer YSt-9 were dissolved in 36.6 g of solvent CS-1 at 110° C. An aqueous gelatin solution of 107.5 g gelatin, 556.8 g water, 9.8 g propionic acid (2N), and 95.9 g of a 10% aqueous solution of surfactant Alkanol XC was prepared at 80° C.

Dispersion 9-18 was prepared similarly to Dispersion 9-17, except that amounts of the components were as follows: 92.5 g of coupler YC2, 23.9 g of stabilizer YSt-1, 3.9 g of stabilizer YSt-5, and 26.4 g stabilizer YSt-9 were dissolved in 27.8 g of solvent CS-1 and 55.5 g compound I-2 at 110° C. An aqueous gelatin solution of 81.5 g gelatin, 606.0 g water, 9.8 g propionic acid (2N), and 72.7 g of a 10% aqueous solution of surfactant Alkanol XC was prepared at 80° C.

Dispersions 9-19 through 9-24 were prepared similarly to Dispersion 9-18, except replacing compound I-2 with the solvents specified in the table below.

The dispersions were evaluated after 24 hours of cold storage at 5° C. The samples were melted and examined for crystals using dark-field cross-polar microscopy at 200× magnification. The results of this evaluation are reported in the table below.

TABLE 16

Dispersions 9-1 to 9-24

| Disp | CS-1: YC2 Ratio | Formula I Compnd | Formula I: YC2 Ratio | Formula I Compnd Melting Point (° C.) | Oil Temp (° C.) | Crystals after 24 hrs at 5° C. | |
|---|---|---|---|---|---|---|---|
| 9-1 | 0.526 | — | — | — | 110 | none | Comp |
| 9-2 | 1.2715 | — | — | — | 110 | none | Comp |
| 9-3 | 0.526 | I-2 | 0.7455 | Liquid at RT | 110 | none | Inv (Preferred) |

TABLE 16-continued

Dispersions 9-1 to 9-24

| Disp | CS-1: YC2 Ratio | Formula I Compnd | Formula I: YC2 Ratio | Formula I Compnd Melting Point (° C.) | Oil Temp (° C.) | Crystals after 24 hrs at 5° C. | |
|---|---|---|---|---|---|---|---|
| 9-4 | 0.526 | I-11 | 0.7455 | 123 | 110 | many | Invention |
| 9-5 | 0.526 | I-12 | 0.7455 | 135 | 125 | very many | Invention |
| 9-6 | 0.526 | I-25 | 0.7455 | 128 | 125 | very many | Invention |
| 9-7 | 0.526 | I-26 | 0.7455 | 124 | 110 | some | Invention |
| 9-8 | 0.526 | I-13 | 0.7455 | 65 | 110 | none | Inv (Preferred) |
| 9-9 | 0.526 | I-14 | 0.7455 | 84 | 110 | none | Inv (Preferred) |
| 9-10 | 0.526 | I-27 | 0.7455 | 105 | 110 | none | Inv (Preferred) |
| 9-11 | 0.526 | I-28 | 0.7455 | 132 | 135 | very many | Invention |
| 9-12 | 0.526 | I-29 | 0.7455 | 93 | 110 | none | Inv (Preferred) |
| 9-13 | 0.526 | I-30 | 0.7455 | Liquid at RT | 110 | none | Inv (Preferred) |
| 9-14 | 0.526 | I-16 | 0.7455 | 50 | 110 | none | Inv (Preferred) |
| 9-15 | 0.526 | I-31 | 0.7455 | 96 | 110 | none | Inv (Preferred) |
| 9-16 | 0.526 | I-32 | 0.7455 | 65 | 110 | none | Inv (Preferred) |
| 9-17 | 0.300 | — | — | — | 110 | none | Comp |
| 9-18 | 0.300 | I-2 | 0.600 | Liquid at RT | 110 | none | Inv (Preferred) |
| 9-19 | 0.300 | I-26 | 0.600 | 124 | 115 | some | Invention |
| 9-20 | 0.300 | I-13 | 0.600 | 65 | 110 | none | Inv (Preferred) |
| 9-21 | 0.300 | I-29 | 0.600 | 93 | 110 | none | Inv (Preferred) |
| 9-22 | 0.300 | I-30 | 0.600 | Liquid at RT | 110 | none | Inv (Preferred) |
| 9-23 | 0.300 | I-16 | 0.600 | 50 | 110 | none | Inv (Preferred) |
| 9-24 | 0.300 | I-32 | 0.600 | 65 | 110 | none | Inv (Preferred) |

Each of dispersions 9-1 to 9-3, 9-7 to 9-10, and 9-12 to 9-24 was combined with a blue-sensitive chloro-iodide emulsion and coated as the first layer of a three-color photographic recording material on a resin-coated paper support. Dispersions 9-4, 9-5, 9-6, and 9-11 contained many crystals and were not coated. Dispersion 9-7 and 9-19 contained some crystals, but coatings were prepared. The subsequent layers were identical for all the coatings and consisted, in order, of a layer containing a scavenger for oxidized developer, a green imaging layer, a second scavenger layer, a red imaging layer, a UV absorbing layer and a protective gelatin super-coat. Details of the structure of the multilayer coating, including component coverages in each layer, are shown below.

In the coating structure, the green imaging layer consisted of a dispersion of coupler MCX mixed with a green-sensitive iodo-chloride emulsion while a similar red-sensitized chloride emulsion was mixed with a dispersion of coupler CCX and CCY to form the red imaging layer. The coupler dispersions were prepared similarly to dispersion 1-1.

| Coating structure | |
|---|---|
| Layer 7 (Supercoat) | |
| Ludox AM ® (DuPont) | 0.1614 $g.m^{-2}$ |
| Gel | 0.6456 $g.m^{-2}$ |
| Coating Surfactants | |
| Layer 6 (UV Layer) | |
| Tinuvin-328 ® | 0.130 $g.m^{-2}$ |
| Tinuvin 326 ® | 0.023 $g.m^{-2}$ |
| DMBHQ | 0.042 $g.m^{-2}$ |

-continued

| Coating structure | |
|---|---|
| CS-6 | 0.051 $g.m^{-2}$ |
| Gel | 0.515 $g.m^{-2}$ |
| Layer 5 (Red-sensitive Layer) | |
| Ag | 0.225 $g.m^{-2}$ |
| Coupler CC-1 | 0.387 $g.m^{-2}$ |
| Coupler CC-2 | 0.043 $g.m^{-2}$ |
| Tinuvin 328 ® | 0.591 $g.m^{-2}$ |
| CS-6 | 0.165 $g.m^{-2}$ |
| CS-7 | 0.493 $g.m^{-2}$ |
| Gel | 2.364 $g.m^{-2}$ |
| Layer 4 (Interlayer B) | |
| DMBHQ | 0.086 $g.m^{-2}$ |
| CS-2 | 0.157 $g.m^{-2}$ |
| Gel | 0.753 $g.m^{-2}$ |
| Layer 3 (Green-sensitive Layer) | |
| Ag | 0.142 $g.m^{-2}$ |
| Coupler MC-1 | 0.269 $g.m^{-2}$ |
| YSt-9 | 0.052 $g.m^{-2}$ |
| YSt-8 | 0.354 $g.m^{-2}$ |
| CS-8 | 0.282 $g.m^{-2}$ |
| CS-2 | 0.145 $g.m^{-2}$ |
| Gel | 1.339 $g.m^{-2}$ |
| Layer 2 (Interlayer A) | |
| DMBHQ | 0.086 $g.m^{-2}$ |
| CS-2 | 0.157 $g.m^{-2}$ |
| Gel | 0.753 $g.m^{-2}$ |
| Layer 1 (Blue-sensitive Layer) | |
| Ag | 0.226 $g.m^{-2}$ |
| Coupler YC2 | 0.462 $g.m^{-2}$ |
| YSt-1 | 0.193 $g.m^{-2}$ |
| YSt-5 | 0.0275 $g.m^{-2}$ |

-continued

| Coating structure | |
|---|---|
| YSt-9 | 0.110 $g.m^{-2}$ |
| Coupler solvent(s) | as determined by dispersion used |
| HQ-K | 0.0095 $g.m^{-2}$ |
| MHR | 0.0064 $g.m^{-2}$ |
| Gel | 1.203 $g.m^{-2}$ |
| Hardener | 0.151 $g.m^{-2}$ |

Support
MHR = 2,5-dihydroxy-5-methyl-3-(4-morpholinyl)-2-cyclopenten-1-one
HQ-K = 2,5-dihydroxy-4-(1-methylheptadecyl)-benzenesulphonic acid (K salt)
Latex copolymer = 50/50 t-butylacrylamide/t-butylacrylate latex copolymer
DMBHQ = 2,5-di-(1,1,3,3-tetramethylbutyl)hydroquinone
Hardener = bis(vinylsulphonyl)methane Sample strips of the coatings were exposed, processed and ted as in Example 4. The results are shown in Table 17.

TABLE 17

Photographic Results for Coatings 901 through 920.

| Ctg | Disp | Formula 1 Compound | Shldr | Dmax | HID3W10 | b* | |
|---|---|---|---|---|---|---|---|
| 901 | 9-1 | — | 1.93 | 2.18 | −0.14 | 1.02 | Comparison |
| 902 | 9-2 | — | 1.94 | 2.17 | −0.2025 | −0.07 | Comparison |
| 903 | 9-3 | I-2 | 1.93 | 2.21 | −0.118 | 0.17 | Inv (Preferred) |
| 904 | 9-7 | I-26 | 1.89 | 2.14 | −0.121 | 3.64 | Invention |
| 905 | 9-8 | I-13 | 1.92 | 2.19 | −0.109 | 0.36 | Inv (Preferred) |
| 906 | 9-9 | I-14 | 1.94 | 2.20 | −0.1195 | 0.25 | Inv (Preferred) |
| 907 | 9-10 | I-27 | 1.93 | 2.19 | −0.159 | 0.19 | Inv (Preferred) |
| 908 | 9-12 | I-29 | 1.96 | 2.21 | −0.1135 | 0.11 | Inv (Preferred) |
| 909 | 9-13 | I-30 | 1.94 | 2.20 | −0.13 | 0 | Inv (Preferred) |
| 910 | 9-14 | I-16 | 1.93 | 2.19 | −0.1235 | 0.3 | Inv (Preferred) |
| 911 | 9-15 | I-31 | 1.93 | 2.20 | −0.1355 | 0.33 | Inv (Preferred) |
| 912 | 9-16 | I-32 | 1.93 | 2.19 | −0.115 | 0.22 | Inv (Preferred) |
| 913 | 9-17 | — | 1.93 | 2.19 | −0.1585 | 1.77 | Comparison |
| 914 | 9-18 | I-2 | 1.92 | 2.18 | −0.122 | 0.51 | Inv (Preferred) |
| 915 | 9-19 | I-26 | 1.92 | 2.17 | −0.124 | 5.18 | Invention |
| 916 | 9-20 | I-13 | 1.92 | 2.18 | −0.1165 | 0.81 | Inv (Preferred) |
| 917 | 9-21 | I-29 | 1.96 | 2.26 | −0.1405 | 0.8 | Inv (Preferred) |
| 918 | 9-22 | I-30 | 1.93 | 2.19 | −0.134 | 1.1 | Inv (Preferred) |
| 919 | 9-23 | I-16 | 1.94 | 2.19 | −0.129 | 1.23 | Inv (Preferred) |
| 920 | 9-24 | I-32 | 1.92 | 2.19 | −0.1235 | 0.8 | Inv (Preferred) |

Comparison of coatings 902 to 901 shows an improvement in pressure fog by increasing the coupler solvent, but the light stability was degraded. Addition of a compound of Formula I in accordance with the invention having a melting point of less than 110° C. to coatings 901 and 913, as represented by coatings 903, 905 through 912 and 914, 916 through 920, respectively, enabled reactivity to be maintained, improved pressure fog and improved light stability. Coatings 904 and 915 with compound I-26 with a higher melting point show improved image stability, but also higher pressure fog. These data show that in accordance with preferred embodiments of the invention the R1, R2 and R3 groups are preferably selected such that the melting point of the resulting compound is less than 110° C. In all cases where the compound of Formula I is employed, the use of CS-1 as a co-solvent enables very little change in shoulder and especially Dmax.

The invention has been described by reference to preferred embodiments, but it will be understood changes can be made to the embodiments specifically described herein within the spirit and scope of the invention.

What is claimed is:

1. A photographic element comprising a silver halide emulsion layer having associated therewith an acetanilide-based yellow dye-forming coupler and a compound of the Formula I:

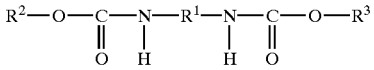

wherein $R^1$, $R^2$ and $R^3$ are each independently aromatic, cyclic, linear, or branched chained hydrocarbon groups.

2. An element according to claim 1, wherein $R^1$ comprises from 1 to 30 carbon atoms and $R^2$ and $R^3$ each comprise from 1 to 22 carbon atoms.

3. An element according to claim 2, wherein $R^1$ comprises from 6 to 22 carbon atoms.

4. An element according to claim 3, wherein $R^2$ and $R^3$ each comprise from 2 to 14 carbon atoms.

5. An element according to claim 1, wherein $R^2$ and $R^3$ each comprise a linear, cyclic or branched chained alkyl group of from 1 to 22 carbon atoms.

6. An element according to claim 1, wherein $R^2$ and $R^3$ each comprise from 4 to 10 carbon atoms.

7. An element according to claim 1, wherein the compound of Formula I is the reaction product of a diisocyanate and monohydric alcohols.

8. An element according to claim 7, wherein the diisocyanate comprises isophorone diisocyanate, p-phenylene diisocyanate, toluene diisocyanate, 4,4'-methylenebis-(phenylisocyanate), 1,5-naphthalene diisocyanate, bitolyene diisocyanate, m-xylylene diisocyanate, m-tetramethyl xylylene diisocyanate, 1,6-diisocyanato-2,2,4,4-tetramethylhexane, trans-cylcohexane-1,4-diisocyanate, 1,3-bis(isocyanatomethyl)cyclohexane, dicyclohexylmethane diisocyanate, methylene diisocyanate, ethylene diisocyanate, or tri-, tetra-, penta-, hexa-, nona- or decamethylene diisocyanate.

9. An element according to claim 8 wherein the monohydric alcohol comprises ethanol, propanol, iso-propanol, butanol, iso-butanol, pentanol, hexanol, ethylhexanol, nonanol, iso-nonanol, decanol, iso-decanol, undecanol, dodecanol, tridecanol, tetradecanol, myristyl alcohol, pentadecyl alcohol, cetyl alcohol, stearyl alcohol, arachidyl alcohol, behenyl alcohol, undecylenyl alcohol, palmitoleyl alcohol, oleyl alcohol, linoleyl alcohol, linolenyl alcohol, arachidonyl alcohol, erucyl alcohol, benzyl alcohol, cyclohexyl alcohol, phenoxyethanol, or phenol.

10. An element according to claim 1, wherein the $R^1$, $^2$ and $R^3$ groups are selected such that the melting point of the resulting compound is less than 110° C.

11. An element according to claim 1, wherein the silver halide emulsion layer further has associated therewith a substituted phenolic light stabilizer compound.

12. An element according to claim 11, wherein the molar ratio of compound of Formula I to substituted phenolic light stabilizer compound is from 1:12 to 25:1.

13. An element according to claim 11, wherein the substituted phenolic light stabilizer compound is a substituted bisphenolic light stabilizer compound.

14. An element according to claim 13 wherein the substituted bisphenol compound is of the formula:

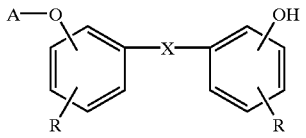

wherein A represents an alkyl, cycloalkyl, alkenyl, aryl, acyl, alkylsulfonyl or arylsulfonyl group, X represents a single bond or a bivalent linking group, and each R independently represents one or more alkyl, alkenyl, cycloalkyl, or aryl group, or in combination with the benzene ring to which it is attached represents the atoms necessary to complete a fused ring system.

15. An element according to claim 14, wherein the molar ratio of compound of Formula I to substituted bisphenolic light stabilizer compound is from 1:12 to 25:1.

16. An element according to claim 14, wherein X represents a single bond or an alkylidene group, oxygen, sulfur, selenium, tellurium, or a sulfonyl or phosphinyl group.

17. An element according to claim 14, wherein X represents an alkylidene group.

18. An element according to claim 1, wherein the yellow coupler is of the formula

YELLOW-1

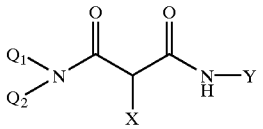

YELLOW-2

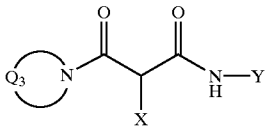

YELLOW-3

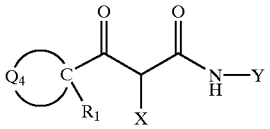

or

YELLOW-4

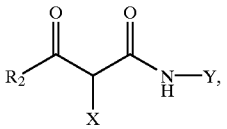

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring.

19. An element according to claim 18, wherein the yellow coupler is of the formula YELLOW-4 where $R_2$ represents an aryl or alkyl group and Y represents an aryl group.

20. An element according to claim 19, wherein $R_2$ represents a tertiary alkyl group.

21. An element according to claim 1, wherein the molar ratio of compound of formula I to yellow coupler is from 0.05:1 to 4:1.

22. An element according to claim 1, wherein the molar ratio of compound of formula I to yellow coupler is from 0.1:1 to 2.5:1.

* * * * *

UNITED STATES PATENT AND TRADEMARK OFFICE

CERTIFICATE OF CORRECTION

PATENT NO. : 6,413,707 B1
DATED : July 2, 2002
INVENTOR(S) : Kurt M. Schroeder et al.

It is certified that error appears in the above-identified patent and that said Letters Patent is hereby corrected as shown below:

Title page,
Item [74], should read as follows:
-- [74] *Attorney, Agent, or Firm*-Andrew J. Anderson --

Signed and Sealed this

Twenty-third Day of November, 2004

JON W. DUDAS
*Director of the United States Patent and Trademark Office*